US009949523B2

(12) United States Patent
Klein et al.

(10) Patent No.: US 9,949,523 B2
(45) Date of Patent: Apr. 24, 2018

(54) MASK

(71) Applicant: F3 Tech, LLC., Derby, CT (US)

(72) Inventors: Jason Klein, Derby, CT (US); Aaron Engel, Unionville, CT (US)

( * ) Notice: Subject to any disclaimer, the term of this patent is extended or adjusted under 35 U.S.C. 154(b) by 353 days.

(21) Appl. No.: 14/787,591

(22) PCT Filed: May 1, 2014

(86) PCT No.: PCT/US2014/036418

§ 371 (c)(1),
(2) Date: Oct. 28, 2015

(87) PCT Pub. No.: WO2014/179604

PCT Pub. Date: Nov. 6, 2014

(65) Prior Publication Data

US 2016/0066642 A1 Mar. 10, 2016

Related U.S. Application Data

(63) Continuation-in-part of application No. 13/874,808, filed on May 1, 2013, now abandoned.

(51) Int. Cl.
*A42B 3/20* (2006.01)

(52) U.S. Cl.
CPC ..... *A42B 3/20* (2013.01)

(58) Field of Classification Search
CPC .... A42B 3/04; A42B 3/08; A42B 3/18; A42B 3/202; F16B 5/0241
USPC ..... 2/9, 10, 411, 424
See application file for complete search history.

(56) References Cited

U.S. PATENT DOCUMENTS

| | | | | |
|---|---|---|---|---|
| 1,203,564 | A * | 11/1916 | April | A42B 3/20 2/9 |
| 4,028,743 | A | 6/1977 | Christensen | |
| 4,083,065 | A | 4/1978 | Warncke | |
| 4,086,664 | A | 5/1978 | Humphrey et al. | |
| 4,136,403 | A | 1/1979 | Walther et al. | |
| 4,363,140 | A | 12/1982 | Correale | |
| 4,370,759 | A | 2/1983 | Zide | |
| 5,101,517 | A | 4/1992 | Douglas | |
| 5,129,108 | A | 7/1992 | Copeland et al. | |
| 5,694,649 | A | 12/1997 | Hefling et al. | |
| 5,713,082 | A | 2/1998 | Bassette et al. | |
| 5,856,811 | A | 1/1999 | Shih et al. | |
| 5,956,777 | A | 9/1999 | Popovich | |
| 6,378,140 | B1 | 4/2002 | Abraham et al. | |
| 6,446,270 | B1 | 9/2002 | Durr | |
| 6,795,978 | B2 | 9/2004 | Fournier et al. | |
| 6,795,979 | B2 | 9/2004 | Fournier | |
| 6,859,946 | B2 | 3/2005 | Fournier et al. | |
| 6,865,752 | B2 | 3/2005 | Udelhofen et al. | |
| 6,928,662 | B2 | 8/2005 | Fournier | |
| 7,210,174 | B2 | 5/2007 | Yeh | |
| 7,607,179 | B2 | 10/2009 | Shih | |
| 9,648,920 | B1 * | 5/2017 | Kuntz | A42B 3/20 |

(Continued)

*Primary Examiner* — Katherine Moran
(74) *Attorney, Agent, or Firm* — Paul & Paul; John S. Child, Jr.; Ourmazd S. Ojan

(57) ABSTRACT

A shock absorber, for use with headgear having a faceguard, has a sliding member that does not extend beyond the support structure of the shock absorber in a way that would leave it vulnerable to damage. A headgear having a faceguard provides a protected mounting location for mounting a shock absorber for the faceguard.

38 Claims, 24 Drawing Sheets

(56) References Cited

U.S. PATENT DOCUMENTS

| | | | | |
|---|---|---|---|---|
| 2002/0121793 | A1 | 9/2002 | Rice | |
| 2003/0213050 | A1 | 11/2003 | Fournier | |
| 2003/0217745 | A1 | 11/2003 | Guay et al. | |
| 2007/0151003 | A1 | 7/2007 | Shih | |
| 2007/0266471 | A1 | 11/2007 | Lin | |
| 2008/0163410 | A1 | 7/2008 | Udelhofen | |
| 2012/0186004 | A1 | 7/2012 | Mechling et al. | |
| 2012/0233745 | A1 | 9/2012 | Veazie | |
| 2015/0135413 | A1* | 5/2015 | Mayerovitch ..... | A42B 3/125 2/414 |

* cited by examiner

Fig. 13
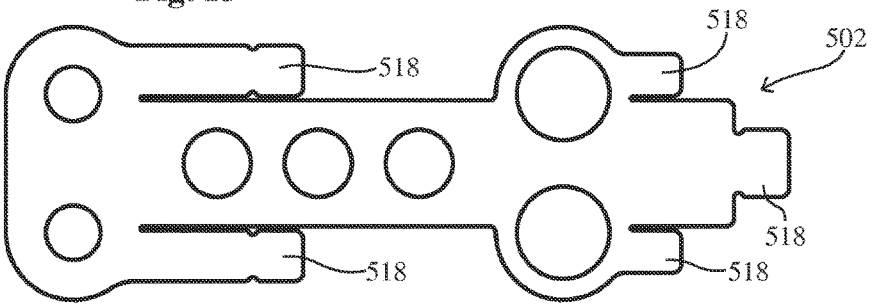
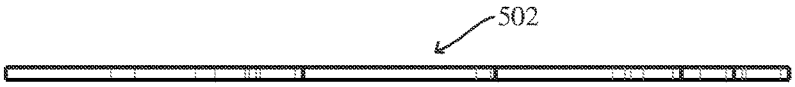
Fig. 14

Fig. 26
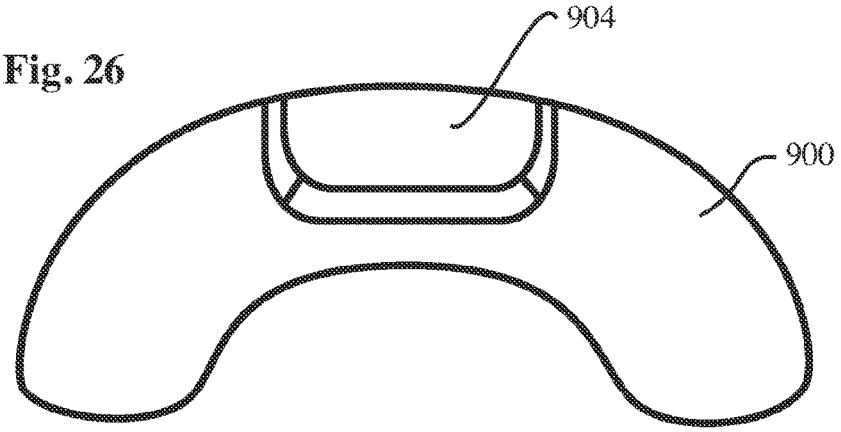
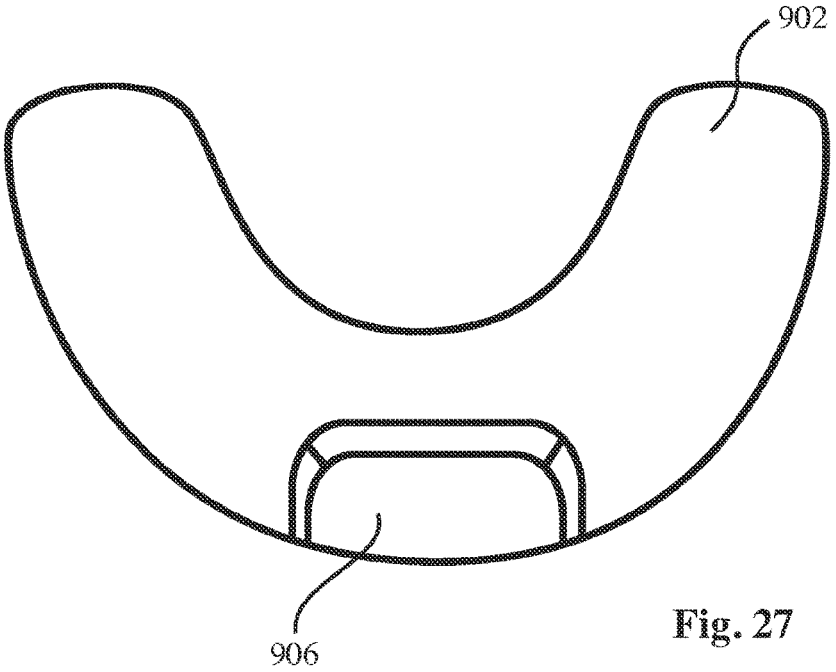
Fig. 27

Fig. 28
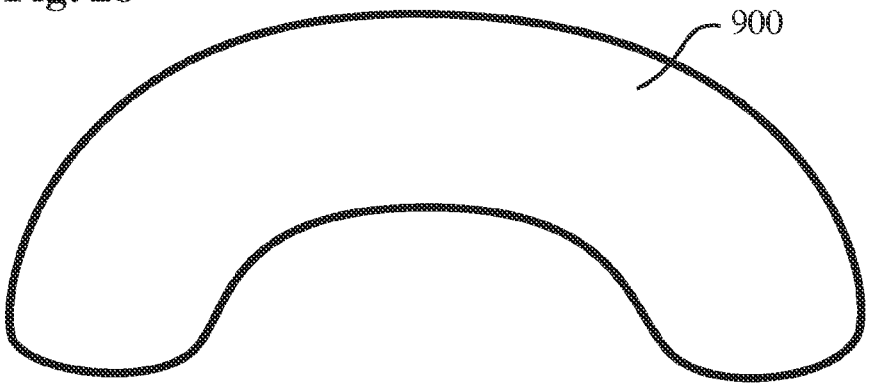
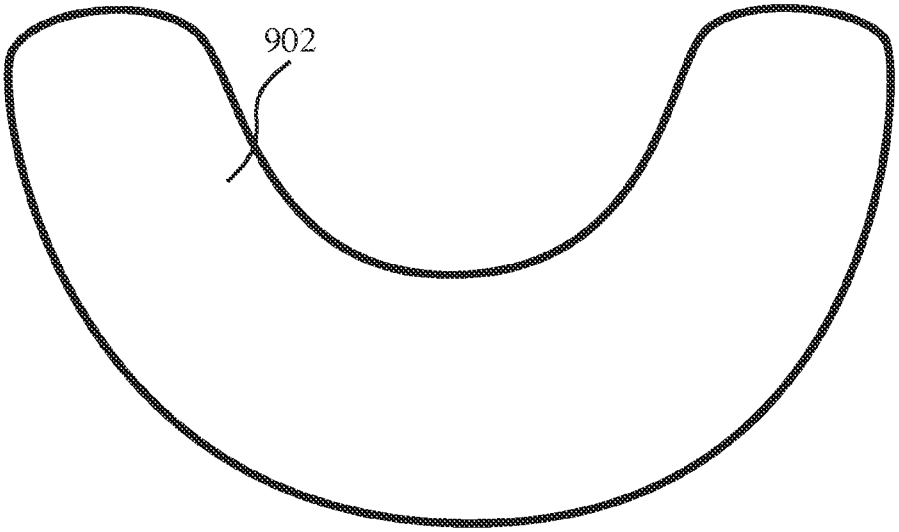
Fig. 29

MASK

CROSS-REFERENCE TO RELATED APPLICATIONS

This application is a United States national stage application of International application number PCT/US2014/036418, filed on May 1, 2014, which claims the priority of U.S. patent application Ser. No. 13/874,808, filed on May 1, 2013, both of which are incorporated herein by reference in their entirety.

BACKGROUND OF THE INVENTION

1. Field of the Invention

The present invention relates to headgear having a faceguard that is provided with shock absorbing means and to a shock absorber suitable for use as the shock absorbing means.

2. Description of the Prior Art

The health effects of concussions, including repeated minor concussions, suffered by athletes engaged in sports where there is a substantial risk of severe impacts to the athlete's head and face have become a major concern to the athletes, sports teams, governing bodies of sports leagues, and the public in recent years. Impacts to the head may also cause neck injuries that are sometimes severe enough to cause the athlete to become paralyzed. This is particularly a concern with impacts directed frontally toward the face. Athletes in such sports have traditionally worn protective headgear in the form of a hard helmet with a facemask rigidly attached to the helmet. Soft cushioning pads are provided inside the helmet around the wearer's head excluding the facial area. In some other sports, for example baseball, the protective headgear is simply a rigid facemask with cushioning padding on the outer frame that is held against the area around the wearer's face. Although the traditional headgear does mitigate the effect of impacts to the head and neck to some extent, they do not reduce the risk of head or neck injury to the desired degree. Accordingly, protective headgear having shock absorbing elements between the faceguard portion and the head-engaging portion of the headgear have been proposed in the prior art to further reduce the risk of injury. However, none of the prior art headgear with shock absorbing faceguards have been widely adopted. The need remains for a shock absorber for use with the faceguard of headgear that is robust enough, compact enough, unobtrusive enough, and adaptable enough for large scale adoption. The need also remains for headgear that can effectively incorporate such a shock absorber. There is also a need for headgear that will keep the shock absorber well protected. None of the prior art headgear are seen to teach or suggest the unique features of the present invention or to achieve the advantages of the present invention that will become apparent from the description and drawings that follow.

SUMMARY OF THE INVENTION

The present invention is directed to a shock absorber and headgear that employs the shock absorber. The headgear includes a faceguard and a head-engaging member. The shock absorber supports the protective faceguard relative to the head-engaging member. The shock absorber includes a support structure, a guide rod, a sliding member, and a resilient member. The support structure is adapted for rigid attachment to either the head-engaging member or the faceguard. The guide rod is supported by the support structure in a fixed position relative to the support structure. The guide rod has first and second end portions, a length, and a longitudinal axis. The guide rod is supported by the support structure near the end portions of the guide rod. The sliding member is guided by the guide rod for rectilinear movement in a direction parallel to the longitudinal axis of the guide rod. The movement of the sliding member is confined between the ends of the guide rod. The sliding member is adapted for rigid attachment to either the head engaging-member or the faceguard depending upon which of these is the one to which the support structure is attached. The resilient member acts on the sliding member to bias the sliding member toward one end of the guide rod. In the illustrated example, the resilient member is a coil spring that is provided on the guide rod between the sliding member and the second end portion of the guide rod and biases the sliding member toward the first end portion of the guide rod. In the illustrated example, the support structure is attached to the head-engaging member and the sliding member is attached to the faceguard. When an object impacts the faceguard, the sliding member is pushed from one end of the guide rod toward the other end resulting in the compression of the coil spring. Thus, the resilient member, in this case the coil spring, can absorb at least a portion of the impact energy of the object and cushion the blow to the faceguard.

The headgear of the present invention includes a head-engaging portion and a faceguard. In a first illustrative embodiment, the head-engaging portion includes first and second enclosed frames. The first frame is larger and designed to surround the wearer's face. The first frame is the closest to the wearer's face. The second frame surrounds the wearer's face and appears roughly concentric with the first frame when viewed from the front in relation to the wearer's face. The second frame is spaced apart from the first frame such that it is farther from the wearer's face as compared to the first frame. The second frame is connected to the first frame by pairs of L-shaped bars. Each pair of L-shaped bars supports a shock absorber in a protected location between the first and second frames of the head-engaging portion. The faceguard includes an enclosed frame that surrounds the wearer's face when viewed from the front in relation to the wearer's face. The frame of the faceguard is larger than the second frame of the head-engaging portion and envelops the second frame of the head-engaging portion when viewed from the front in relation to the wearer's face. The faceguard includes a first plurality of bars that are substantially parallel to the sagittal plane of the wearer's body and a second plurality of bars that are parallel to the transverse plane of the wearer's body. These pluralities of bars are attached to the frame of the faceguard such that they are positioned in front of the wearer's face and can thus provide protection to the wearer's face. The pluralities of bars are positioned to provide complete protection to the entire frontal area of the wearer's head. The frame of the faceguard is attached to the plurality of shock absorbers.

In the first illustrative embodiment, the support structure of shock absorber is rigidly attached to a corresponding pair of the L-shaped bars while the sliding member is rigidly attached to the frame of the faceguard.

In a second illustrative embodiment, the support structure of the shock absorber is adapted for being welded to the head-engaging portion of the headgear. Also, screw fasteners are used to secure the guide rods to the support structure.

In a third illustrative embodiment, the support structure of the shock absorber is of a modified form.

In a fourth illustrative embodiment, the head-engaging portion includes a shield and fixed frame combination. The shield covers the forehead, the forward top portion of the skull, the sides of the head, and the chin of the wearer. The shield has a face opening for the area corresponding to the mouth, nose, and eyes of the wearer. The fixed frame is fixedly attached to the shield on the interior of the shield such that the fixed frame is positioned intermediate the shield and the wearer's head. The fixed frame essentially surrounds the area corresponding to the face opening of the shield. Three shock absorber units made in accordance with the present invention support the faceguard relative to the head-engaging portion. These three shock absorber units attach the face guard to the fixed frame and thus to the head-engaging portion. The shield has openings that allow the shock absorber units to be attached to the fixed frame.

The shield may be made of fiberglass, carbon-fiber composite, KEVLAR®, molded polycarbonate, combinations thereof, and any other material suitable for use in the protective shell of protective headgear.

Another aspect of the invention is to provide suitable padding designed to be interposed between the wearer's head and the rigid parts of the head-engaging portion of the headgear of the present invention. The padding provided as part of the head-engaging portion of the headgear of the present invention should accommodate the shock absorber units such that the shock absorber units can be properly installed and can operate without hindrance.

The term head-engaging portion or member as used herein can include, without limitation, a frame, a shield, a helmet, combinations thereof, their associated padding, padding straps, and straps for securing the headgear of the present invention to the wearer's head. Depending on the materials employed and the intended use, the shock absorber units may be attached to the shield or the helmet rather than to a fixed frame.

The shock absorber or the headgear could be configured such that the sliding member is attached to the head-engaging portion and the support structure of the shock absorber is attached to the faceguard. Also the attachments between the shock absorber and the head-engaging portion or the attachment between the shock absorber and the faceguard or both could be made flexible instead of rigid as long as the attachment means used is resilient and strong enough to withstand the punishment it would be expected to receive.

Accordingly, it is an object of the invention to provide a shock absorber for a faceguard that has a sliding member that does not extend beyond the support structure of the shock absorber so that the sliding member is not in a vulnerable position.

It is another object of the invention to provide a shock absorber for a faceguard that is robust.

It is yet another object of the invention to provide a shock absorber for a faceguard that is compact.

It is yet another object of the invention to provide a shock absorber for a faceguard that is unobtrusive.

It is yet another object of the invention to provide a shock absorber for a faceguard that is adaptable to a wide variety of applications.

It is yet another object of the invention to provide a headgear that provides a protected mounting location for mounting a shock absorber for a faceguard.

These and other objects of the present invention will become apparent from the attached description and drawings.

BRIEF DESCRIPTION OF THE DRAWINGS

FIGS. 13-14 are views of the support structure or support bracket of the shock absorber according to the third embodiment of the present invention before it is bent into final form.

FIGS. 26-31 are views of pads suitable for use with the protective headgear according to the present invention.

Similar reference characters denote corresponding features consistently throughout the appended drawings.

DETAILED DESCRIPTION OF THE PREFERRED EMBODIMENTS

Figure 1:
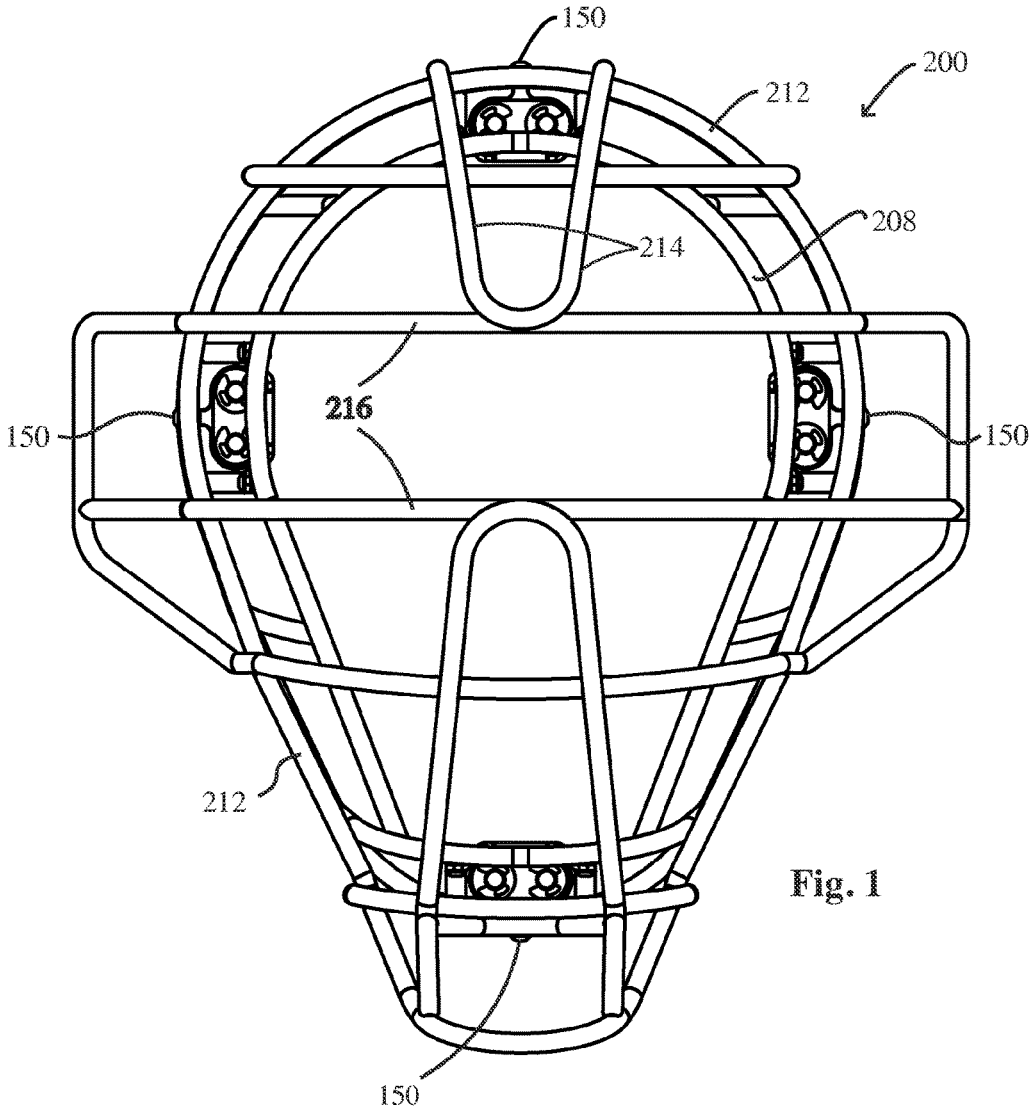
FIG. 1 is a front view of the headgear according to the present invention.
Figure 3:
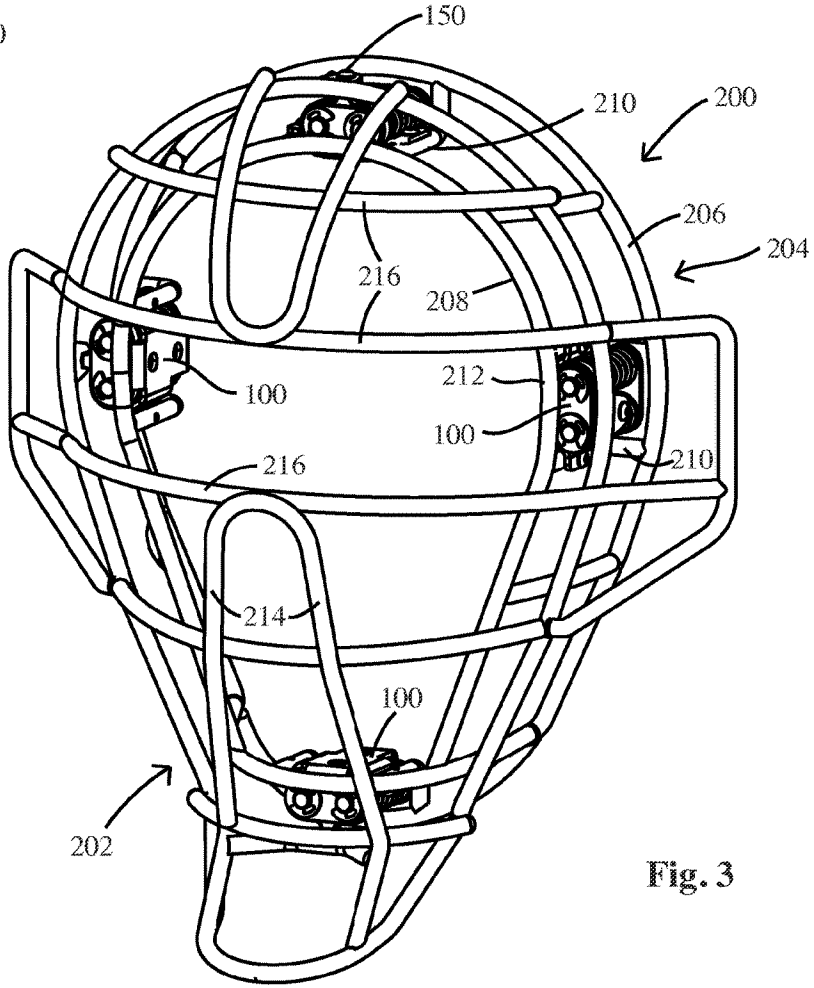
FIG. 3 is a front isometric view of the headgear according to the present invention.
Figure 2:
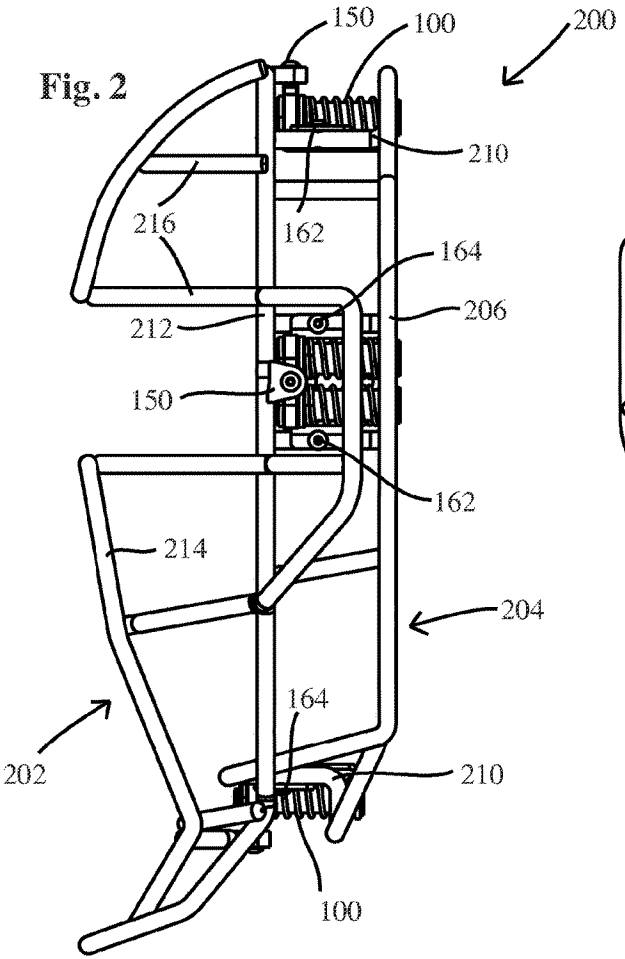
FIG. 2 is a right side view of the headgear according to the present invention.
Figure 5:
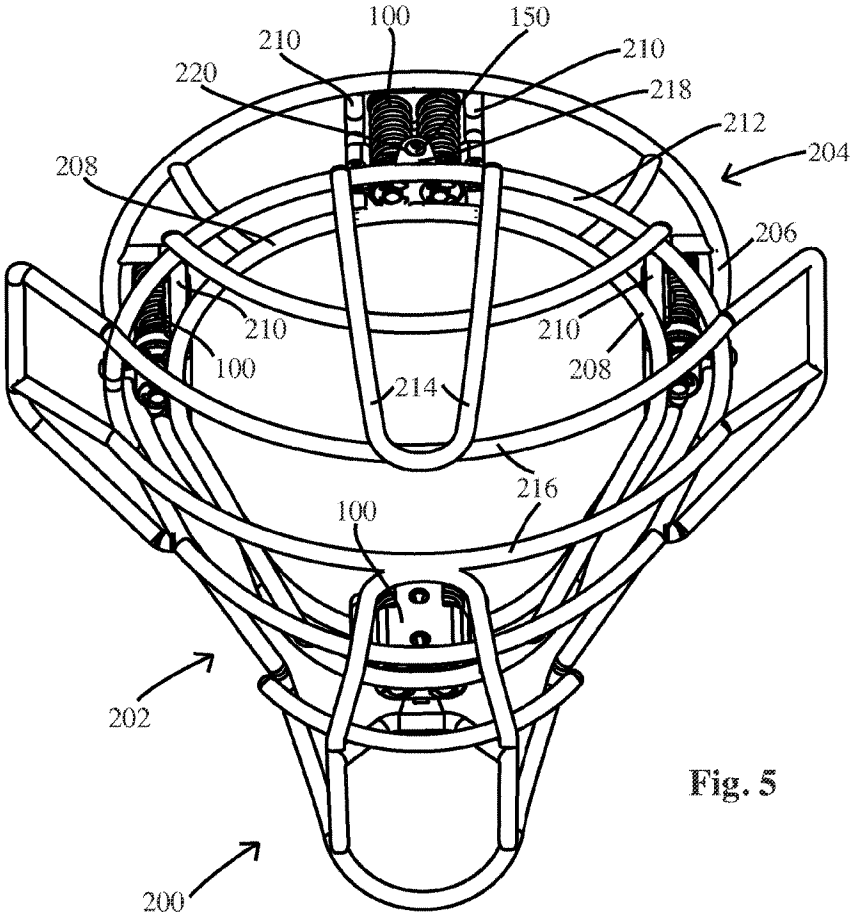
FIG. 5 is a top isometric view of the headgear according to the present invention.
Figure 4:
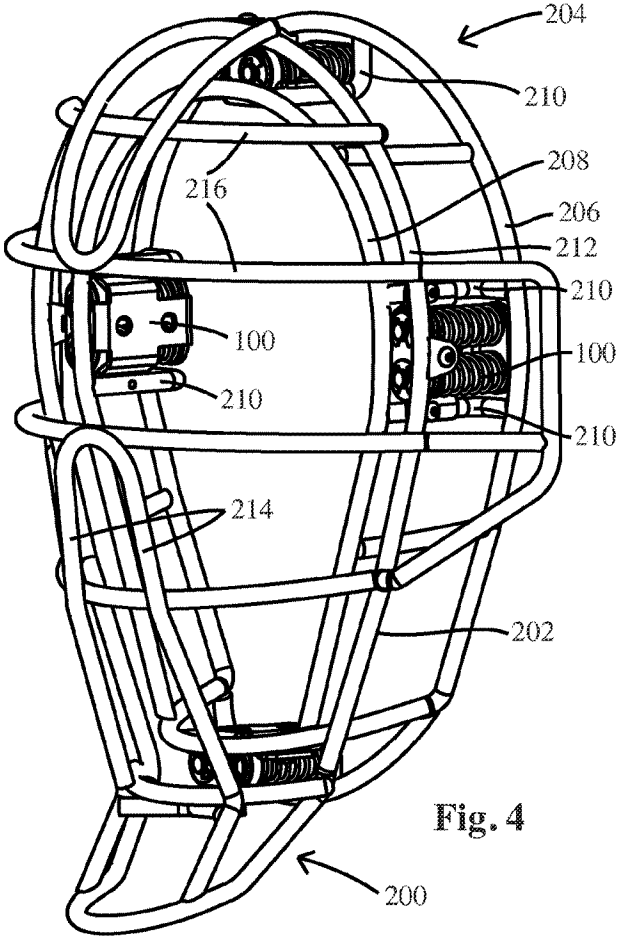
FIG. 4 is a rear isometric view of the headgear according to the present invention.
Figure 7:
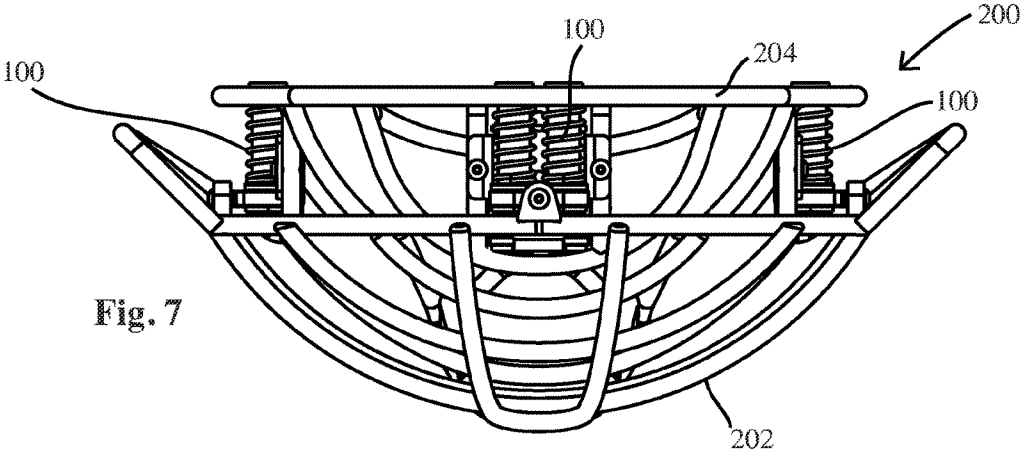
FIG. 7 is a bottom view of the headgear according to the present invention.
Figure 6:
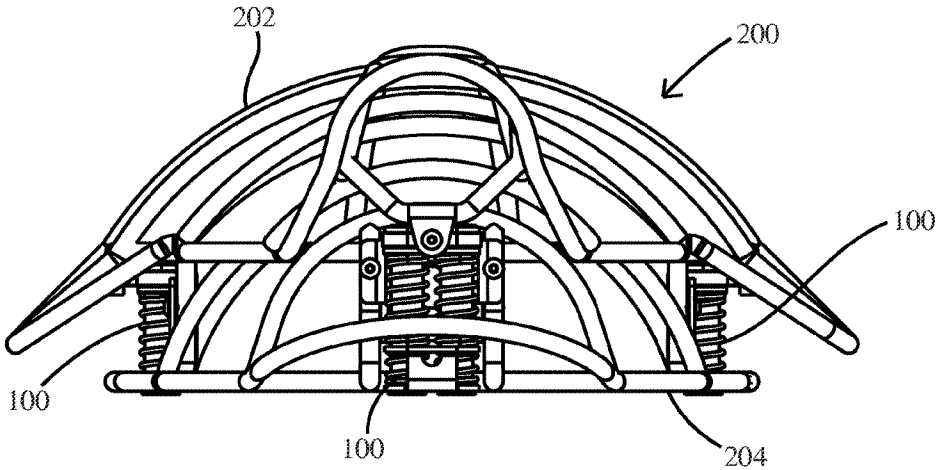
FIG. 6 is a top view of the headgear according to the present invention.
Figure 8:
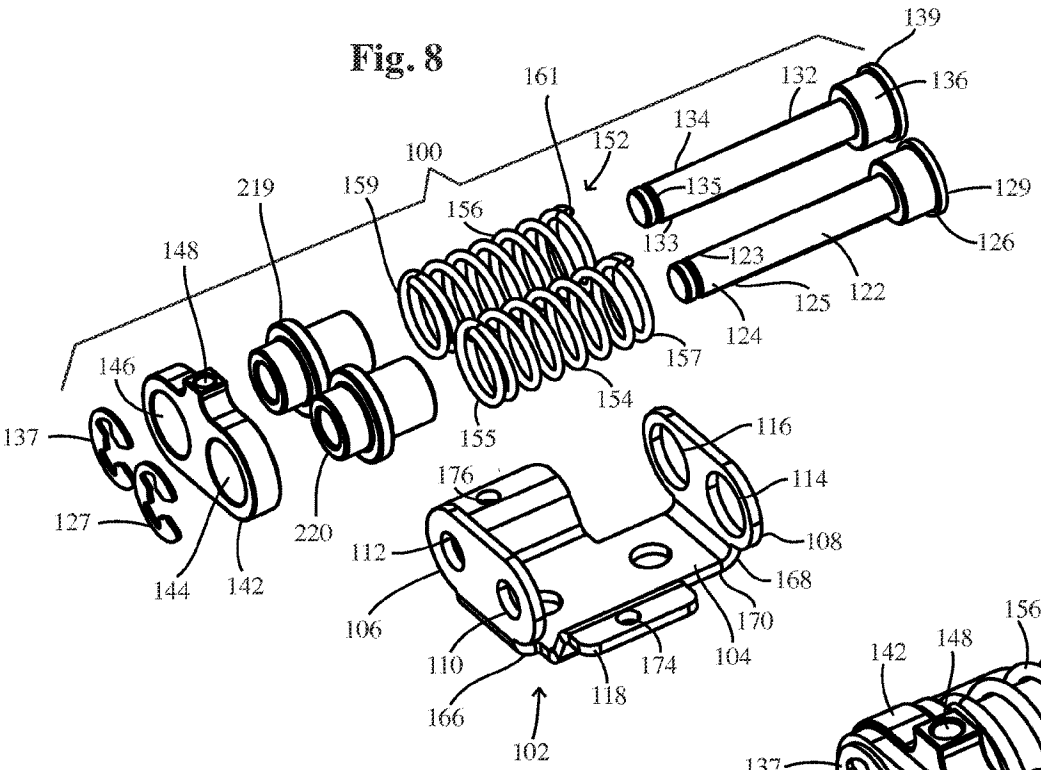
FIG. 8 is an isometric view of the shock absorber according to the present invention.
Figure 9:
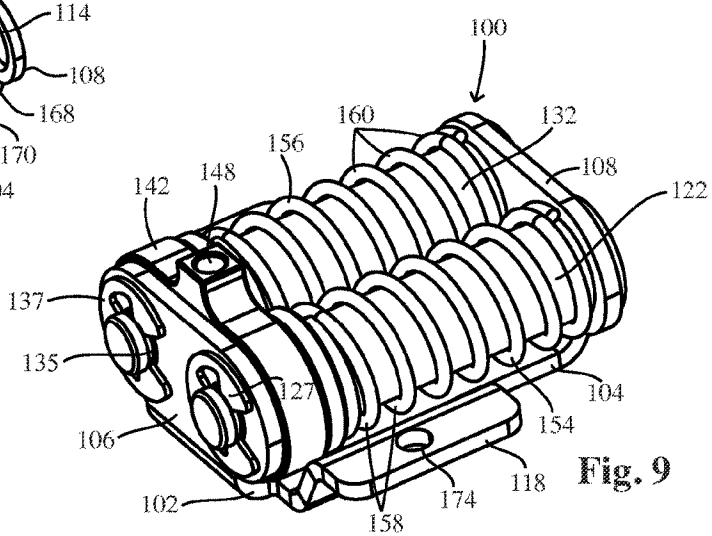
FIG. 9 is an exploded view of the shock absorber according to the present invention.

Referring to FIGS. 1-9, the first illustrative embodiment of the present invention is directed to a shock absorber 100 and headgear 200 that employs a shock absorber such as, for example, the shock absorber 100. The headgear 200 includes a faceguard 202 and a head-engaging member 204. The shock absorber 100 supports the protective faceguard 202 relative to the head-engaging member 204. The shock absorber 100 includes a support structure 102, a guide rod 122 or 132, a sliding member 142, and a resilient member 152. The support structure 102 is adapted for rigid attachment to either the head-engaging member 204 or the faceguard 202. The guide rod 122 or 132 is supported by the support structure 102 in a fixed position relative to the support structure 102. The guide rod 122, 132 has first and second end portions, a length, and a longitudinal axis. The guide rod 122, 132 is supported by the support structure 102 near the end portions of the guide rod. The sliding member 142 is guided by the guide rod 122, 132 for rectilinear movement in a direction parallel to the longitudinal axis of the guide rod. The movement of the sliding member 142 is confined between the ends of the guide rod 122, 132. The sliding member 142 is adapted for rigid attachment to either the head-engaging member 204 or the faceguard 202 depending upon which of these is the one to which the support structure is attached. The resilient member 152 acts on the sliding member 142 to bias the sliding member toward one end of the guide rod 122, 132. In the illustrated example, the resilient member is a coil spring 154 or 156 that is provided on the guide rod 122, 132 between the sliding member 142 and the second end portion of the guide rod and biases the sliding member 142 toward the first end portion of the guide rod 122, 132. In the illustrated example, the support structure 102 is attached to the head-engaging member 204 and the sliding member is attached to the faceguard 202. When an object impacts the faceguard 202, the sliding member 142 is pushed from one end of the guide rod 122, 132 toward the other end resulting in the compression of the coil spring 154, 156. Thus, the resilient member 152, in this case the coil spring 154, 156, can absorb at least a portion of the impact energy of the object and cushion the blow to the faceguard 202. The movement of the sliding member 142 is limited to a portion of the length of the guide rod 122, 132. The movement of the sliding member 142 is limited to rectilinear motion in a direction parallel to the longitudinal axis of the guide rod 122, 132.

The headgear 200 of the present invention includes a head-engaging portion 204 and a faceguard 202. The head-engaging portion 204 is made of first and second substantially enclosed frames 206 and 208, respectively. The first frame 206 is larger than the second frame 208 and is designed to surround the wearer's face. The first frame 206 is the closest to the wearer's face. The second frame 208 surrounds the wearer's face and appears roughly concentric with the first frame 206 when viewed from the front in relation to the wearer's face. The second frame 208 is spaced apart from the first frame 206 such that it is farther from the wearer's face as compared to the first frame. The second frame 208 is connected to the first frame 206 by pairs of L-shaped bars 210. Each pair of L-shaped bars 210 supports a shock absorber 100 in a protected location between the first and second frames of the head-engaging portion 204. The faceguard 202 includes a substantially enclosed frame 212 that surrounds the wearer's face when viewed from the front in relation to the wearer's face. The frame 212 of the faceguard 202 is larger than the second frame 208 of the head-engaging portion 204 and envelops the second frame 208 of the head-engaging portion 204 when viewed from the front in relation to the wearer's face. The faceguard 202 includes a first plurality of bars 214 that are substantially parallel to the sagittal plane of the wearer's body and a second plurality of bars 216 that are parallel to the transverse plane of the wearer's body. These pluralities of bars 214, 216 are attached to the frame 212 of the faceguard 202 such that they are positioned in front of the wearer's face and can thus provide protection to the wearer's face. The pluralities of bars 214, 216 are positioned to provide complete protection to the entire frontal area of the wearer's head. The frame 212 of the faceguard 202 is attached to the plurality of shock absorbers 100.

In the illustrated embodiment, the support structure 102 of shock absorber 100 is rigidly attached to a corresponding pair of the L-shaped bars 210 while the sliding member 142 is rigidly attached to the frame 212 of the faceguard 202. The shock absorber 100 or the headgear 200 could be configured such that the sliding member 142 is attached to the head-engaging portion 204 and the support structure 102 of the shock absorber 100 is attached to the faceguard 202. Also the attachments between the shock absorber 100 and the head-engaging portion 204 or the attachment between the shock absorber 100 and the faceguard 202 or both could be made flexible instead of rigid as long as the attachment means used is resilient and strong enough to withstand the punishment it would be expected to receive.

The sliding member 142 has an opening 144 through it and the guide rod 122 extends through the opening 144. The support structure 102 supports the guide rod 122 at the first end portion 124 of the guide rod 122 and at the second end portion 126 of the guide rod 122. The resilient member 152 can be a coil spring 154 that has a plurality of coils. The guide rod 122 extends through the plurality of coils of the coil spring 154. The coil spring 154 is positioned intermediate a portion of the sliding member 142 that surrounds the opening 144 and the second end portion 126 of the guide rod 122.

The coil spring 154 has a first end and a second end, and the first end of the coil spring 154 bears directly or indirectly against a portion of the sliding member 142 that surrounds the opening 144. The second end of the coil spring 154 bears directly or indirectly against a portion of the support structure 102 proximate the second end portion of the guide rod 122.

The sliding member 142 has at least one hole 148 for engagement by at least one sliding member fastener 150 to thereby rigidly attach the sliding member 142 to the faceguard 202.

The support structure 102 has means for engagement by at least one support structure fastener 162, 164 to thereby rigidly attach the support structure 102 to the head-engaging member 204. The support structure 102 is a bracket comprising a base plate 104, a first endplate 106, and a second endplate 108. The first endplate 106 has a hole 110, 112 for the first end portion 124, 134 of the guide rod 122, 132. The second endplate 108 has a hole 114, 116 for the second end portion 126, 136 of the guide rod 122, 132. A first lateral flange 118 is provided on a first side of the base plate 104, and a second lateral flange 120 is provided on a second side of the base plate 104. The first endplate 106 is provided proximate a first end 166 of the base plate 104, and the second endplate 108 is provided proximate a second end 168 of the base plate 104 opposite the first endplate 106. The first lateral flange 118 extends approximately laterally from the first side 170 of the base plate 104, and the second lateral flange 120 extends approximately laterally from the second side 172 of the base plate 104 in a direction approximately opposite that of the first lateral flange 118. Each of the first lateral flange 118 and the second lateral flange 120 has means for engagement by at least one support structure fastener 162, 164 to thereby rigidly attach the support structure 102 to the head-engaging member 204. Each of the first lateral flange 118 and the second lateral flange 120 has a hole 174, 176, respectively, for engagement by a respective support structure fastener 162, 164 to thereby rigidly attach the support structure 102 to the head-engaging member 204. The lateral flanges 118, 120 and the holes 174, 176 constitute the means for engagement by at least one support structure fastener 162, 164 to thereby rigidly attach the support structure 102 to the head-engaging member 204.

In the illustrated embodiment, the shock absorber 100 has two guide rods 122 and 132 and two coil springs 154 and 156. The first guide rod 122 has first and second end portions 124 and 126, a length, and a longitudinal axis. The second guide rod 132 extends in parallel to the first guide rod 122. The second guide rod 132 has first and second end portions 134 and 136, a length, and a longitudinal axis extending parallel to the longitudinal axis of the first guide rod 122.

Accordingly, the sliding member 142 has a first opening 144 and a second opening 146 that extend through the sliding member 142. The first guide rod 122 extends through the first opening 144 and the second guide rod 132 extends through the second opening 146. The support structure 102 supports the first guide rod 122 at the first end portion 124 of the first guide rod 122 and at the second end portion 126 of the first guide rod 122. The support structure 102 supports the second guide rod 132 at the first end portion 134 of the second guide rod 132 and at the second end portion 136 of the second guide rod 132.

The resilient member 152 includes the first coil spring 154 and the second coil spring 156. The first coil spring 154 has a plurality of coils 158 and the first guide rod 122 extends through the plurality of coils of the first spring 154. The second coil spring 156 has a plurality of coils 160 and the second guide rod 132 extends through the plurality of coils of the second spring 156. The first coil spring 154 is positioned intermediate a first portion of the sliding member 142 and the second end 126 of the first guide rod 122. The second coil spring 156 is positioned intermediate a second portion of the sliding member 142 and the second end 136 of the second guide rod 132.

The first coil spring 154 has a first end 155 and a second end 157. The first end 155 of the first coil spring 154 bears directly or indirectly against a first portion of the sliding member 142 and the second end 157 of the first coil spring 154 bears directly or indirectly against a first portion of the support structure 102 proximate the second end 126 of the first guide rod 122. In the illustrated example, the second end 157 of the first coil spring 154 bears directly against the support structure 102, specifically the second endplate 108. The first end 155 of the first coil spring 154 bears indirectly against the sliding member 142. However, the spring 154 may bear directly or indirectly against either of those parts while the shock absorber remains within the scope of the appended claims. For example, one or more washers may be provided between the second end 157 of spring 154 and the second endplate 108 to prevent the spring from marring the endplate, or the first end 155 of the spring 154 may directly contact the sliding member 142 with the shock absorber still remaining functional.

The second coil spring 156 has a first end 159 and a second end 161. The first end 159 of the second coil spring 156 bears directly or indirectly against a second portion of the sliding member 142 and the second end 161 of the second coil spring 156 bears directly or indirectly against a second portion of the support structure 102 proximate the second end 136 of the second guide rod 132. In the illustrated example, the second end 161 of the second coil spring 156 bears directly against the support structure 102, specifically the second endplate 108. The first end 159 of the second coil spring 156 bears indirectly against the sliding member 142. However, the spring 156 may bear directly or indirectly against either of those parts while the shock absorber remains within the scope of the appended claims. For example, one or more washers may be provided between the second end 161 of spring 156 and the second endplate 108 to prevent the spring from marring the endplate, or the first end 159 of the spring 156 may directly contact the sliding member 142 with the shock absorber still remaining functional.

In the illustrated embodiment, the first endplate 106 has a first hole 110 for the first end portion 124 of the first guide rod 122 and a second hole 112 for the first end portion 134 of the second guide rod 132. The second endplate 108 has a first hole 114 for the second end portion 126 of the first guide rod 122 and a second hole 116 for the second end portion 136 of the second guide rod 132. The hole 110 is in registry with the hole 114 and the hole 112 is in registry with the hole 116.

The guide rod 122 has a first diameter and a second diameter. The second diameter is smaller than the first diameter. The second end portion 126 of the guide rod 122 is in large part of the first diameter. The first end portion 124 and the portion of the guide rod 122 extending between the first end portion 124 and a location proximate the second end portion 126 are essentially of the second diameter. This arrangement forms an annular step or shoulder 123 proximate the second end portion 126 of the first guide rod 122. The portion of the rod 122 extending from the shoulder 123 to the second end portion 126 is of the first diameter. The terminal portion of the first end portion 124 of the guide rod 122 extends through the hole 110 in the endplate 106. An annular groove 125 is provided on the terminal portion of the first end portion 124 of the guide rod 122 on the side of the endplate 106 opposite the side of the endplate 106 that faces the sliding member 142. An E-clip or retaining ring 127 is positioned in engagement with the groove 125. In the illustrated embodiment, the guide rod 122 is provided with an annular flange 129 at the terminus of the second end portion 126 that cooperates with the clip 127 to secure the guide rod 122 to the support structure 102. The hole 114 in endplate 108 is sized to provide clearance for the first diameter of the guide rod 122 while providing a bearing surface for the second end portion 126 of the guide rod 122. The hole 110 has a diameter smaller than the first diameter of the guide rod 122 and is sized to provide clearance for the terminal portion of the first end portion 124 of the guide rod 122 that has the second diameter.

The guide rod 132 has a first diameter and a second diameter. The second diameter is smaller than the first diameter. The second end portion 136 is in large part of the first diameter. The first end portion 134 and the portion of the guide rod 132 extending between the first end portion 134 and a location proximate the second end portion 136 are of the second diameter. This arrangement forms an annular step or shoulder 133 proximate the second end portion 136. The portion of the rod 132 extending from the shoulder 133 to the second end portion 136 is of the first diameter. The terminal portion of the first end portion 134 of the guide rod 132 extends through the hole 112 in the endplate 106. An annular groove 135 is provided on the terminal portion of the first end portion 134 of the guide rod 132 on the side of the endplate 106 opposite the side of the endplate 106 that faces the sliding member 142. An E-clip or retaining ring 137 is positioned in engagement with the groove 135. In the illustrated embodiment, the guide rod 132 is provided with an annular flange 139 at the terminus of the second end portion 136 that cooperates with the clip 137 to secure the guide rod 132 to the support structure 102. The hole 116 in endplate 108 is sized to provide clearance for the first diameter of the guide rod 132 while providing a bearing surface for the second end portion 136 of the guide rod 132. The hole 112 has a diameter smaller than the first diameter of the guide rod 132 and is sized to provide clearance for the terminal portion of the first end portion 134 of the guide rod 132 that has the second diameter.

In the illustrated embodiment, the guide rod 122 and the guide rod 132 are identical. One or both of the guide rods 122 and 132 could be configured to provide a second shoulder or flange (not shown) near their second end portions 126, 136 such that the second ends 157 and 161 of the springs 154 and 156 bear against that second shoulder or flange rather than against the second endplate 108. Thus, the second ends 157 and 161 of the springs 154 and 156 may bear indirectly against the support structure 102.

In the illustrated embodiment, a plurality of tabs 218 are provided on the frame 212 of the faceguard 202. Each of the tabs 218 has a hole 220 that is engaged by a respective fastener 150 to secure the sliding member 142 of a respective shock absorber 100 to the faceguard 202. The first plurality of bars 214 may also be attached to one or more of the second plurality of bars 216. It is also possible to make the tabs 218 integral with the sliding member 142, while using a fastener 150 to secure the sliding member 142 to the frame 212 or any of the pluralities of bars 214, 216. The head-engaging member 204 is provided with padding, such as shown in FIGS. 23-27, for engagement with the wearer's head.

In the illustrated embodiment, first and second tubular sleeves 219 and 222 are provided at the openings 144 and 146, respectively, to give a greater bearing surface between the sliding member 142 and the guide rods 122 and 132 so as to reduce tilting of the sliding member relative to the guide rods, thus reducing the possibility of the sliding member 142 jamming on the guide rods. The first and second tubular sleeves 219 and 222 are in engagement with the openings 144 and 146, respectively. The first and second tubular sleeves 219 and 222 are identical to simplify manufacture. Each of the first and second tubular sleeves 219 and 222 has a first portion 224, 226, respectively, and a second portion 228, 230, respectively. Each of the first and second tubular sleeves 219 and 222 has an annular flange 232, 234, respectively, located intermediate its first portion 224, 226 and its second portion 228, 230. The guide rod 122 extends through the first sleeve 219, and the guide rod 132 extends through the second sleeve 222.

The first portion 224 of the first sleeve 219 fits into the opening 144 of the sliding member 142 with the flange 232 of the sleeve 219 abutting the sliding member 142. The second portion 228 of the first sleeve 219 fits into the space between the coils of the spring 154 and the portion of the guide rod 122 that is of the second diameter. The first end 155 of the coil spring 154 engages the flange 232 of the sleeve 219 to bias the sliding member 142 toward the first end portion 124 of the guide rod 122. Thus, the spring 154 indirectly bears against the sliding member 142.

The first portion 226 of the second sleeve 222 fits into the opening 146 of the sliding member 142 with the flange 234 of the sleeve 222 abutting the sliding member 142. The second portion 230 of the second sleeve 222 fits into the space between the coils of the spring 156 and the portion of the guide rod 132 that is of the second diameter. The first end 159 of the coil spring 156 engages the flange 234 of the sleeve 222 to bias the sliding member 142 toward the first end portion 134 of the guide rod 132. Thus, the spring 156 indirectly bears against the sliding member 142.

The illustrated headgear is particularly suited for use by a baseball catcher or umpire. In use, the headgear 200 is secured to the wearer's head using straps (not shown) or the like in the conventional manner. Padding, such as shown in FIGS. 23-27, is provided between the wearer's head and the head-engaging portion 204. The padding and straps must be applied in such a way so as to not interfere with the relative movement between the head-engaging portion 204 and the faceguard 202. Normally, the springs 154, 156 of the shock absorber 100 will bias the sliding member 142 into contact with the first endplate 106. When an object impacts the faceguard 202, the sliding member 142 is pushed toward the endplate 108, which causes the springs 154, 156 to be compressed between the sliding member 142 and the endplate 108. Thus, the springs 154, 156 absorb at least a portion of the impact energy of the object rather than transmitting it to the wearer's head.

Figure 10:
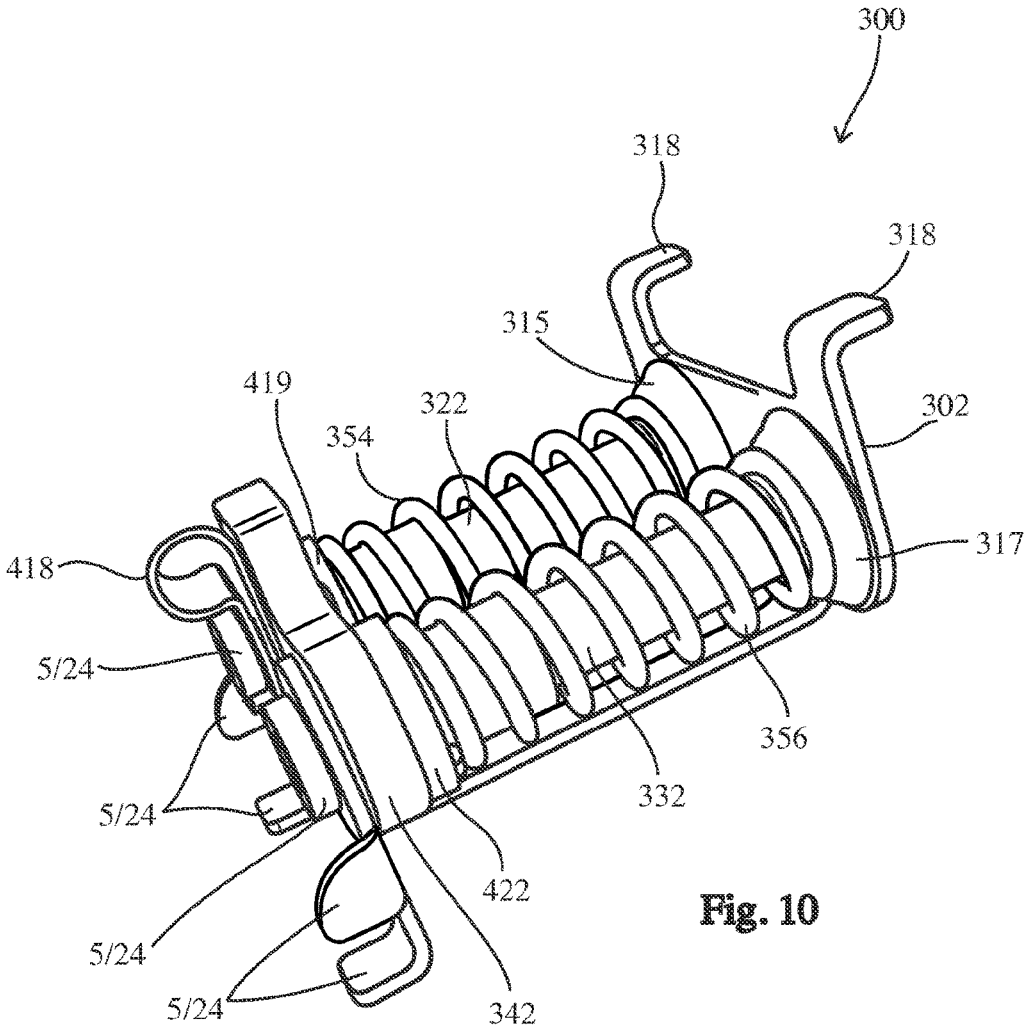
FIG. 10 is an isometric view of the shock absorber according to the second embodiment of the present invention.
Figure 11:
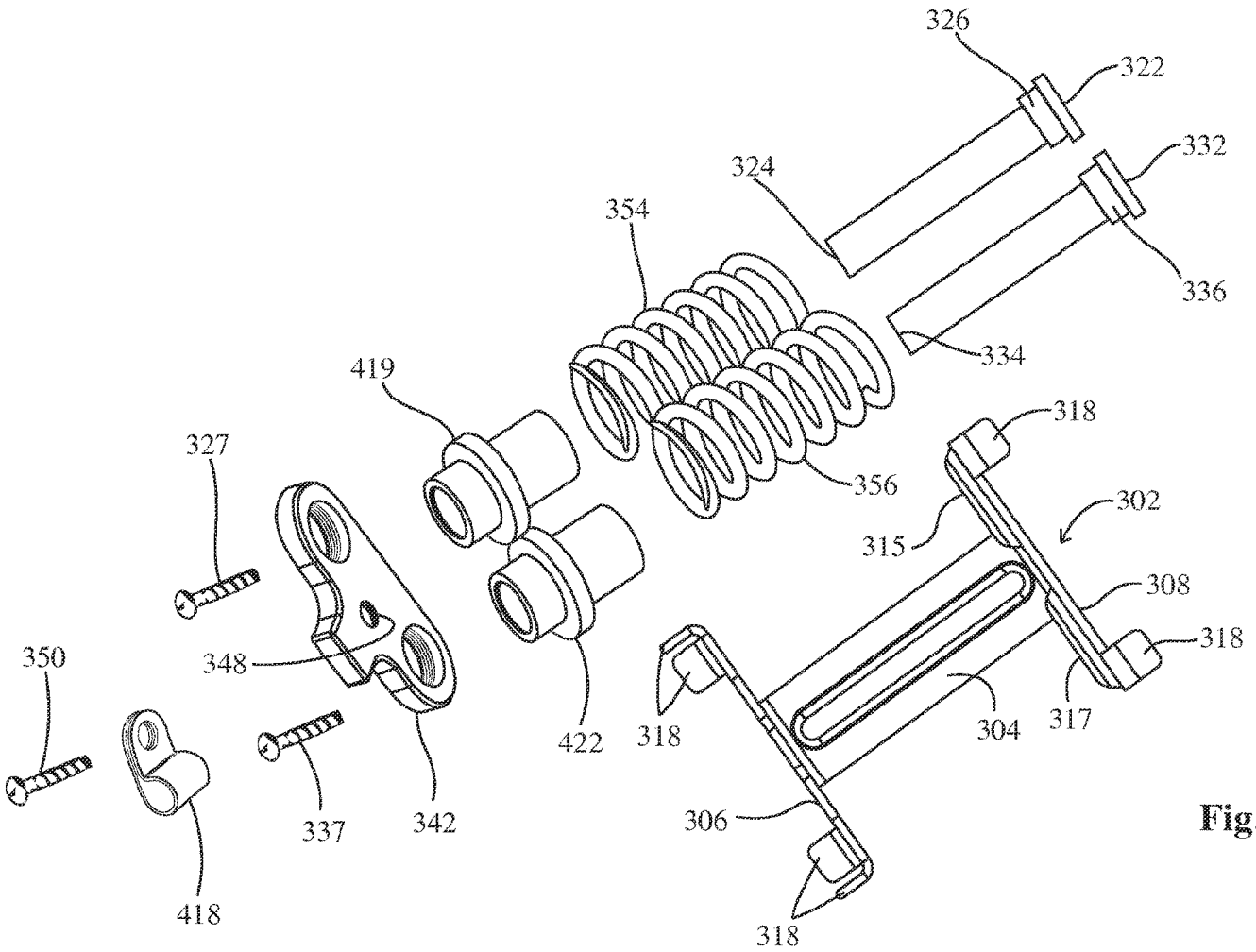
FIG. 11 is an exploded view of the shock absorber according to the second embodiment of the present invention.

Referring to FIGS. 10 and 11, a shock absorber 300 in accordance with the second embodiment of the present invention can be seen. The shock absorber 300 has a support structure 302, two guide rods 322 and 332, two coil springs 354 and 356, first and second tubular sleeves 419 and 422, and a sliding member 342. These parts are essentially identical in structure and function to the corresponding parts of the shock absorber 100, and in turn the shock absorber 300 is essentially identical in structure and function to the shock absorber 100, except as to the differences noted below. The sliding member 342 differs from the sliding member 142 in that the hole 148 is replaced by the hole 348 that extends in the direction of the thickness of the sliding member 342 rather than in the direction perpendicular to the thickness of the sliding member. The hole 348 is threaded to receive a screw fastener 350 that can secure the strap 418 to the sliding member 342. The strap 418 has a loop that extends between two end portions that are each provided with a hole for the shaft of the screw 350. The holes in the end portions of the strap 418 are in registry with one another. The loop of the strap 418 fits around a portion of the frame 212 of the faceguard 202 such that, when the shaft of the screw 350 is placed through the holes in the end portions of the strap 418 and the screw 350 is tightened in the hole 348, the strap 418 is clamped to the frame 212 of the faceguard 202 so as to attach the sliding member 342 to the face guard 202.

The lateral flanges 118, 120 and the holes 174, 176 have been eliminated from the support structure 302. Instead, the support structure 302 is provided with a plurality of tabs 318 that allow the support structure 302 to be welded to the bars of the head-engaging member 204 to thereby fix the support structure 302 to the head-engaging member 204. In addition to welding, soldering and brazing may also be used, although welding is preferred because it ordinarily provides good bond strength.

The support structure 302 is a bracket comprising a base plate 304, a first endplate 306, and a second endplate 308. Each of the guide rods 322, 332 has a threaded hole in the first end portions 324, 334, respectively, for engagement by a respective one of the screw fasteners 327, 337. The first end plate 306 has holes (not shown), corresponding to holes 110, 112 of the support structure 102, that are smaller in diameter than the first end portions 324, 334 of the guide rods 322, 332 but are large enough to allow the shafts of the screw fasteners 327, 337 to extend through the first endplate 306. The screw fasteners 327, 337 engage the threaded holes in the first end portions 324, 334 of the guide rods 322, 332, respectively, in order to secure the guide rods 322, 332 to the support structure 302. The annular grooves 125, 135 and the E-clips 127, 137 are accordingly eliminated from the shock absorber 300.

The second endplate 308 has holes (not shown) corresponding to holes 114, 116 of the support structure 102. The area around the holes in the end plate 308 is dimpled to form dimples 315 and 317 that allow the second end portions 326, 336 of the guide rods 322, 332 to sit substantially flush with the surface of the second endplate 308 on the side opposite the springs 354, 356. The guide rods 322, 332 may be press fit to the holes in the dimples 315, 317, or the second end portions 326, 336 of the guide rods 322, 332 may be welded, brazed, or soldered to the dimples.

Figure 12:
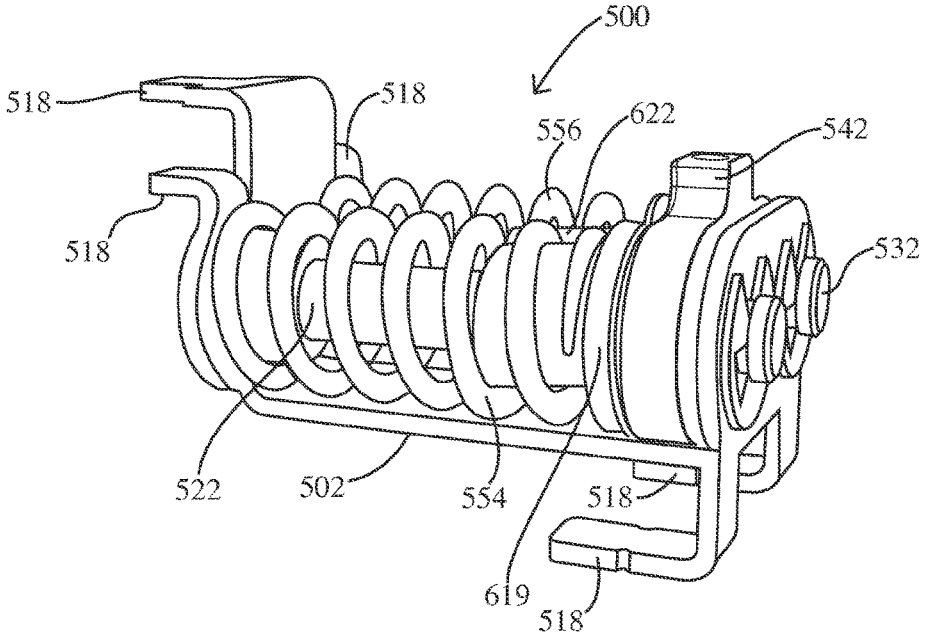
FIG. 12 is an isometric view of the shock absorber according to the third embodiment of the present invention.
Figure 15:
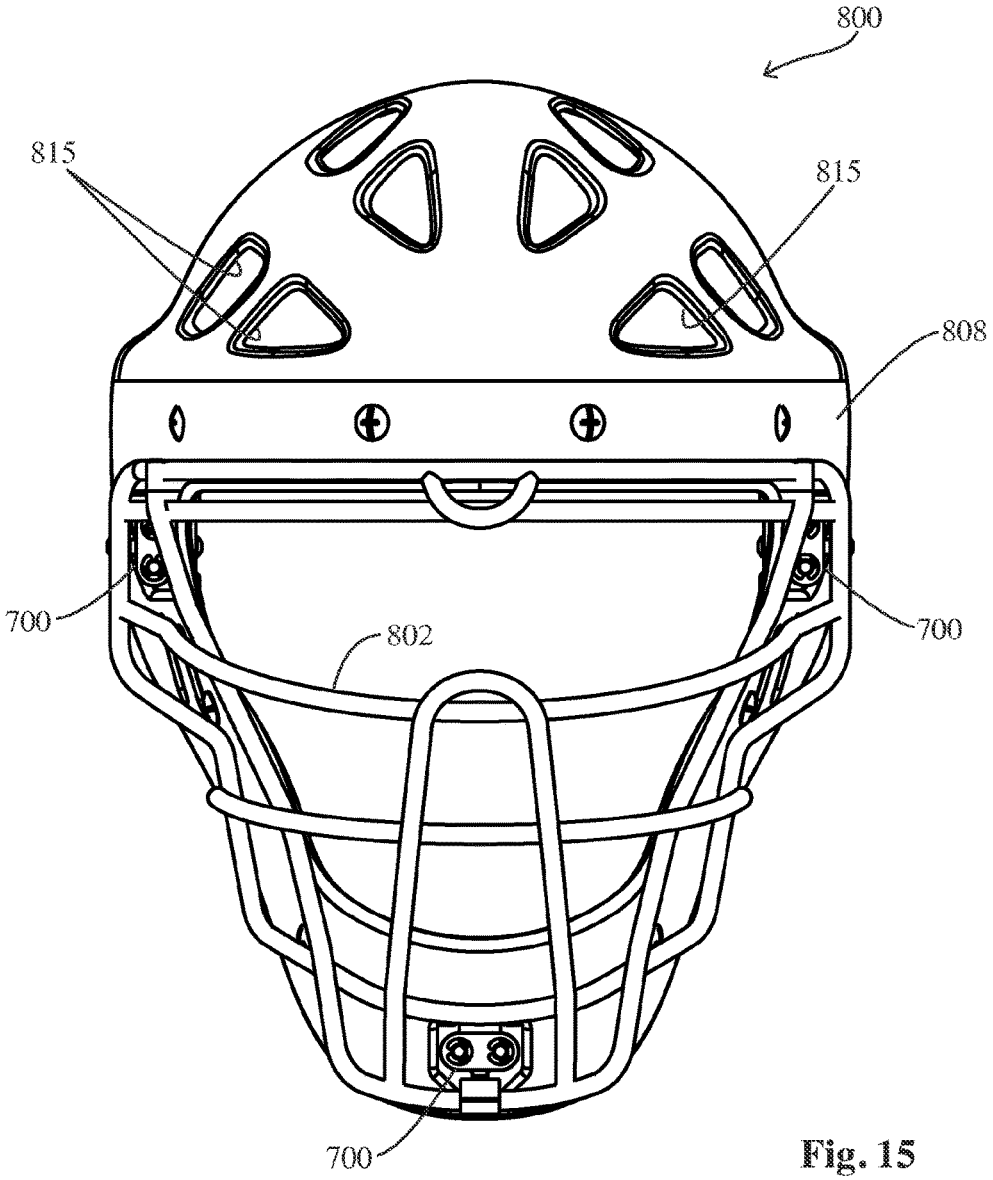
FIGS. 15-25 are views of the protective headgear having a shield and fixed frame combination according to the third embodiment of the present invention.
Figure 16:
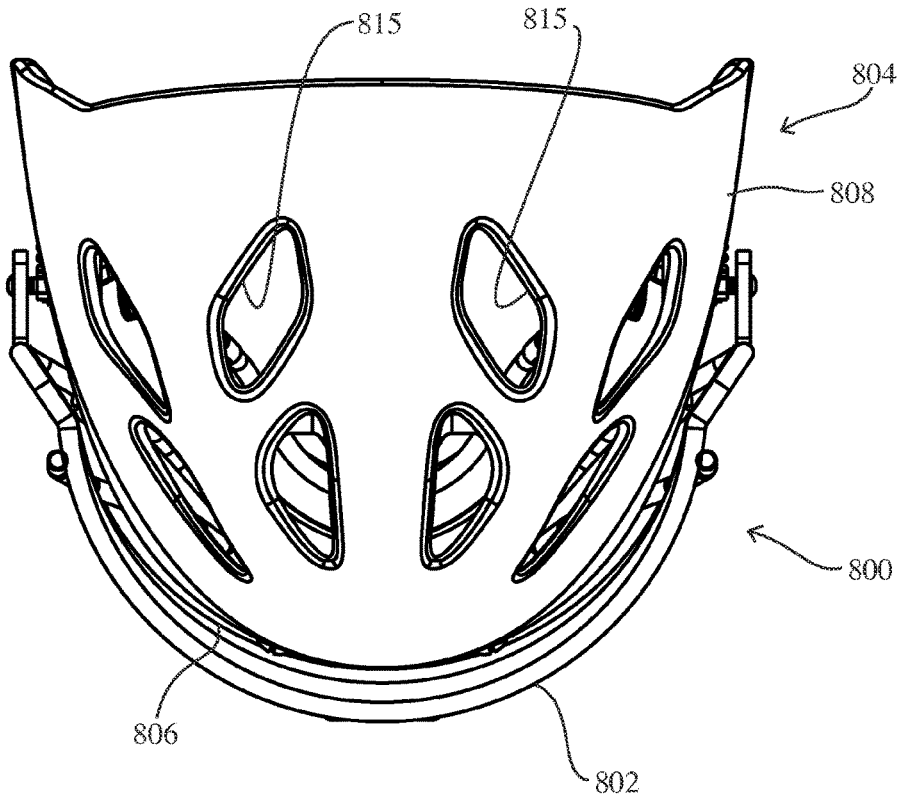
Figure 17:
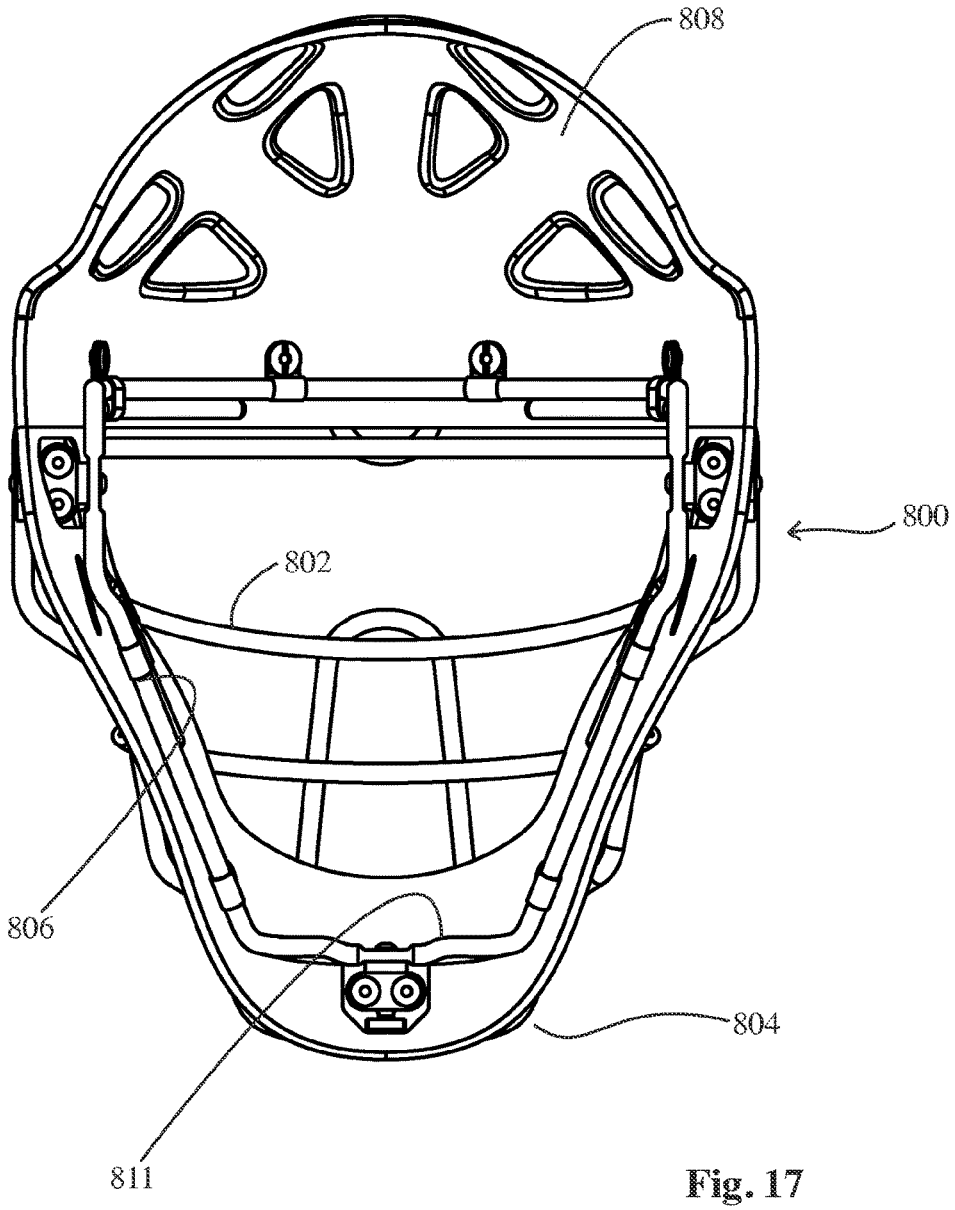
Figure 18:
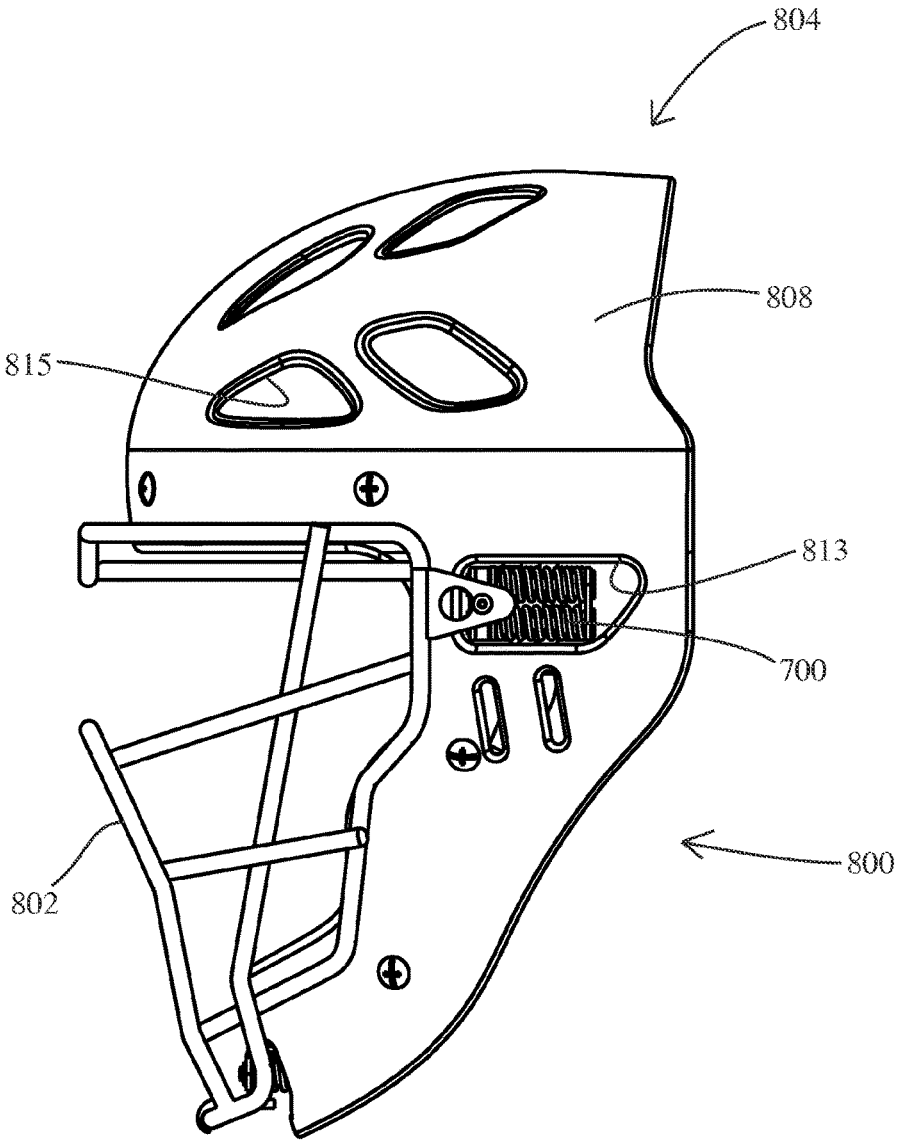
Figure 19:
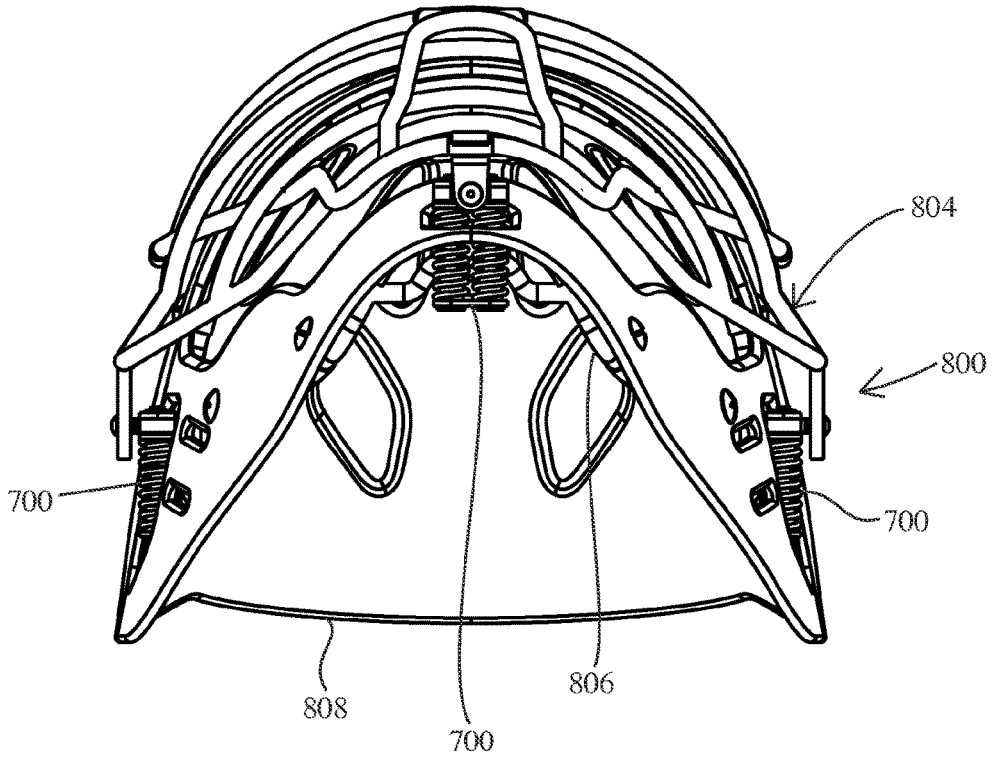
Figure 20:
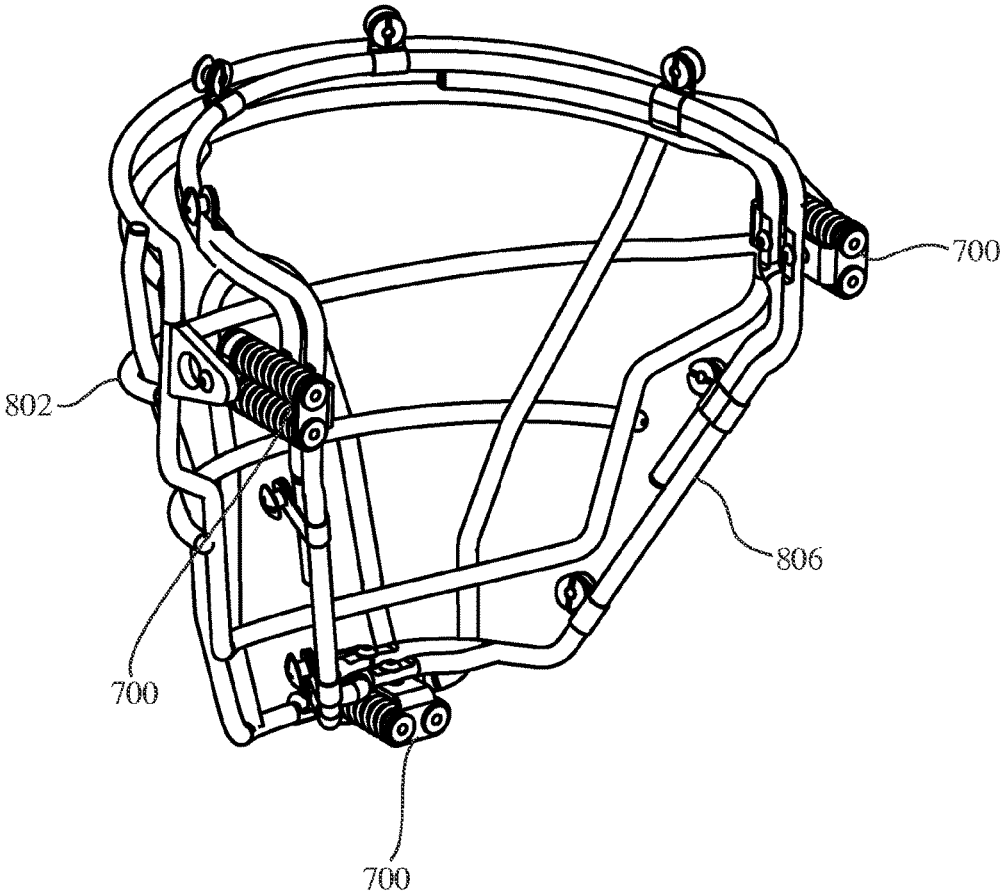
Figure 21:
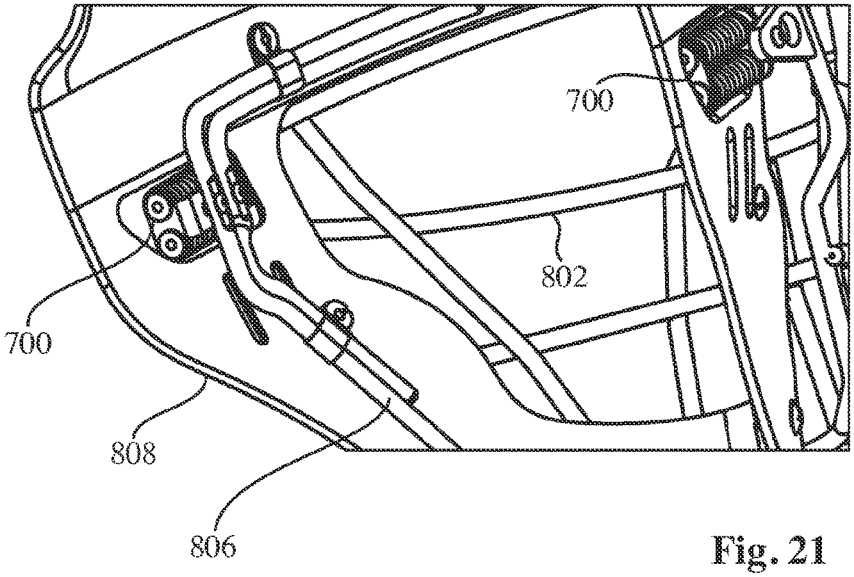
Figure 22:
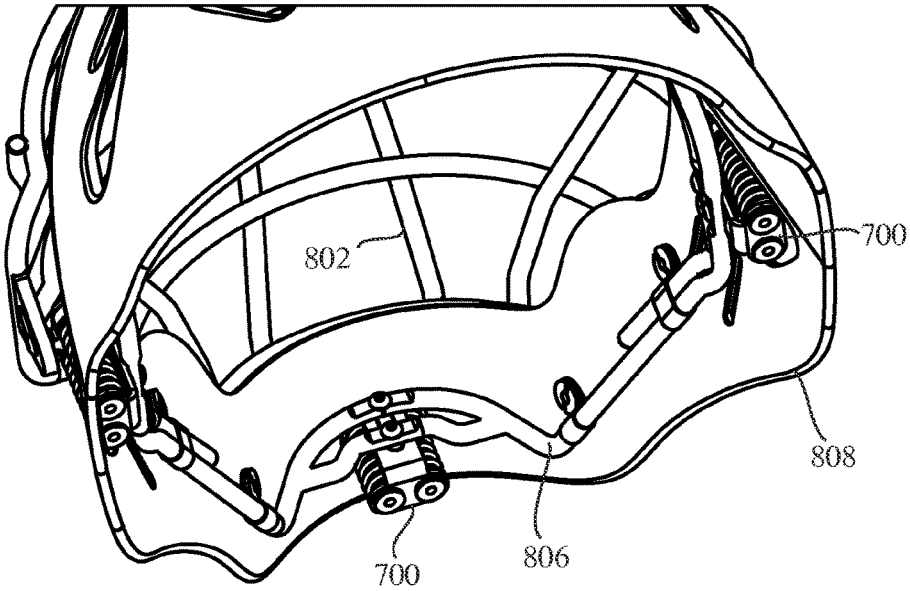
Figure 23:
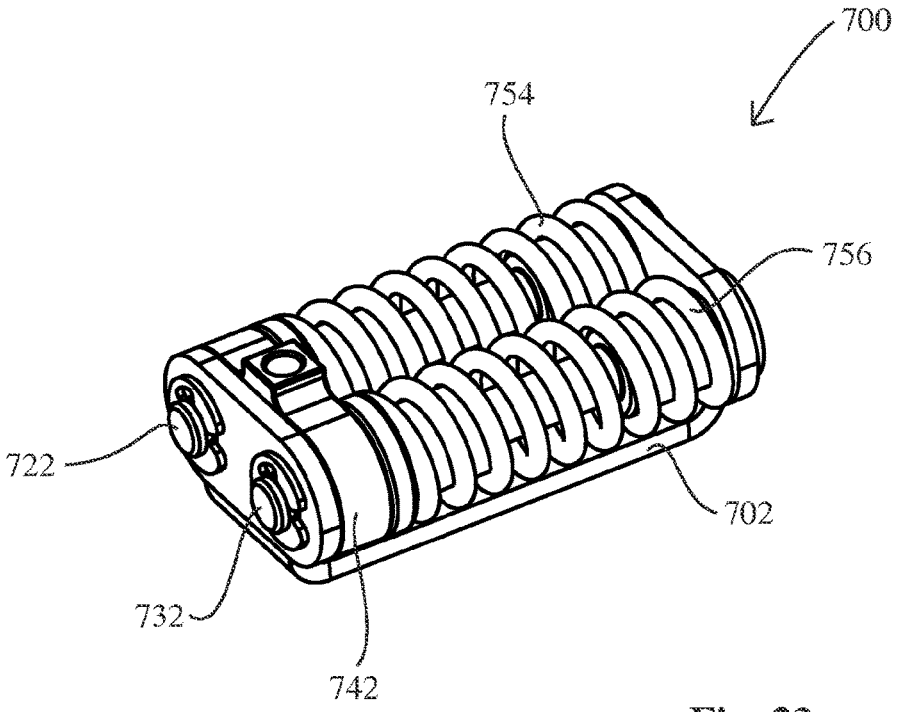
Figure 24:
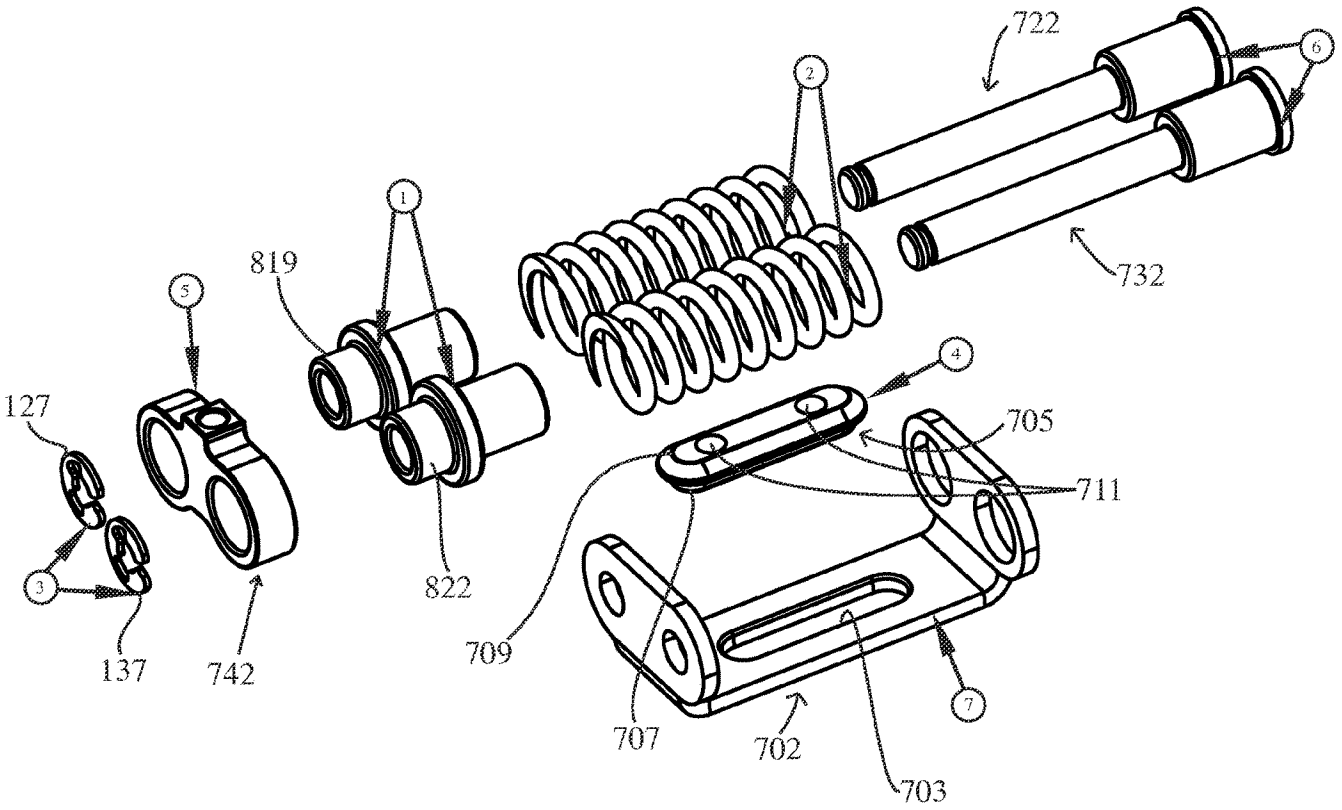
Figure 25:
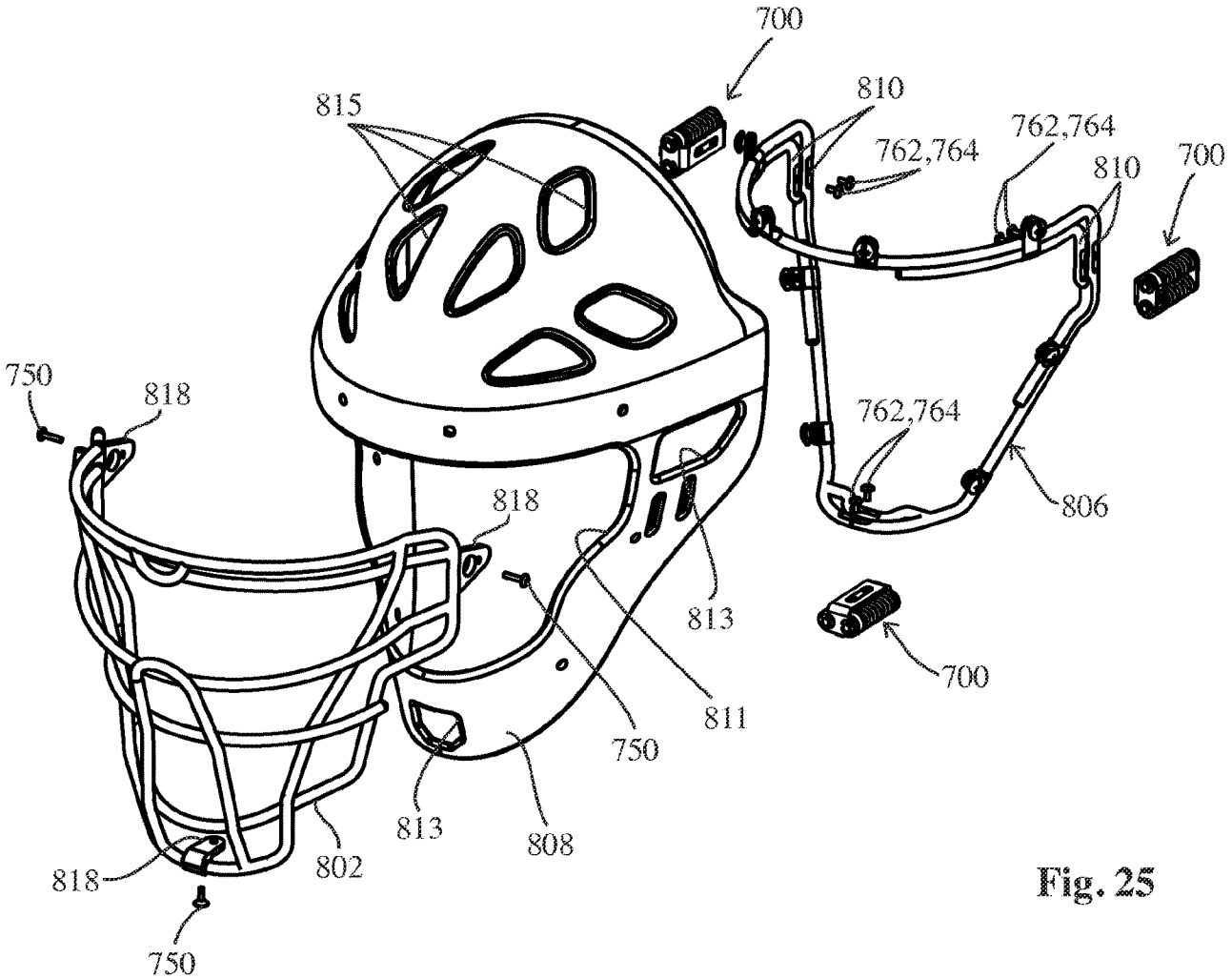
Figure 30:
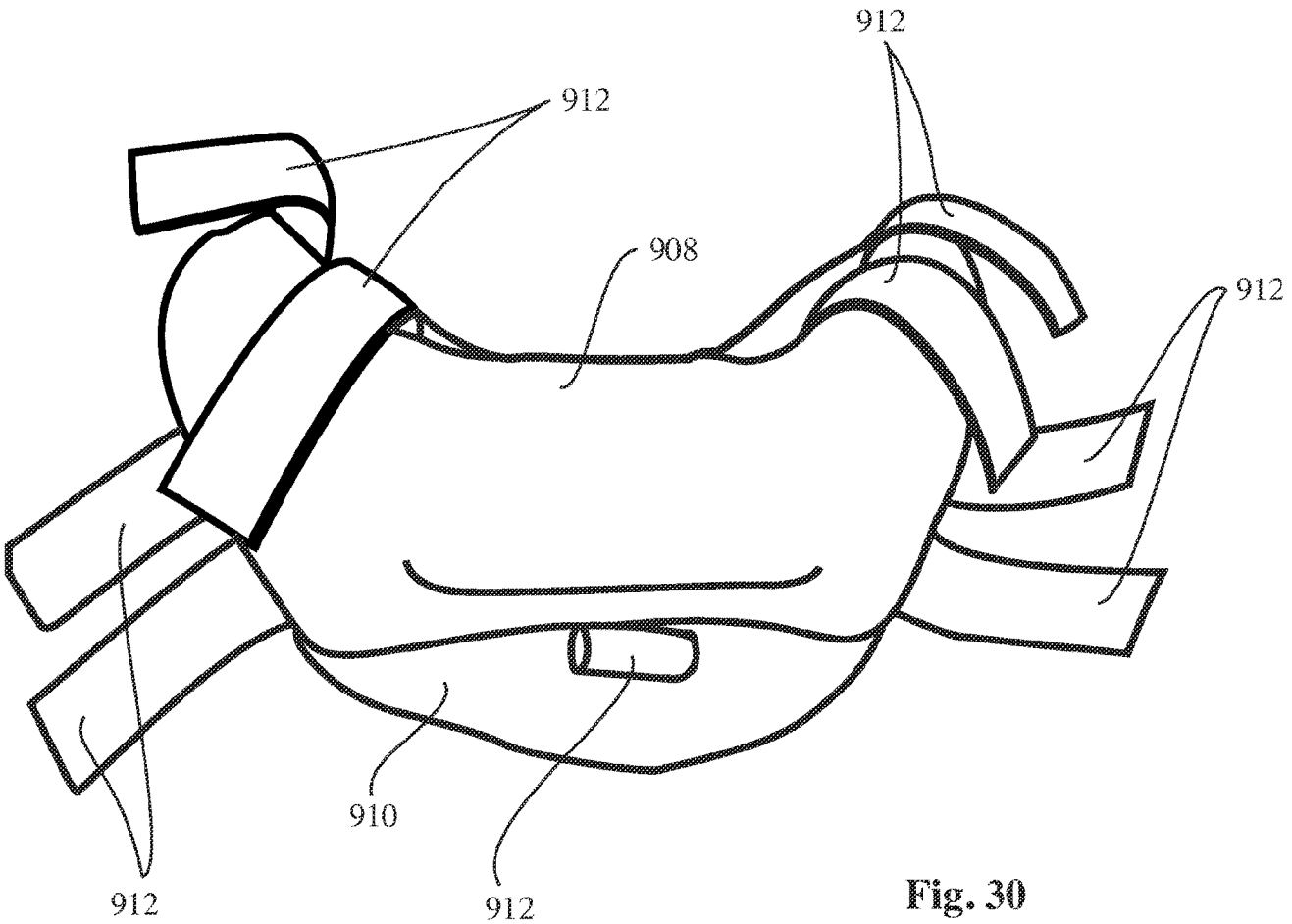
Figure 31:
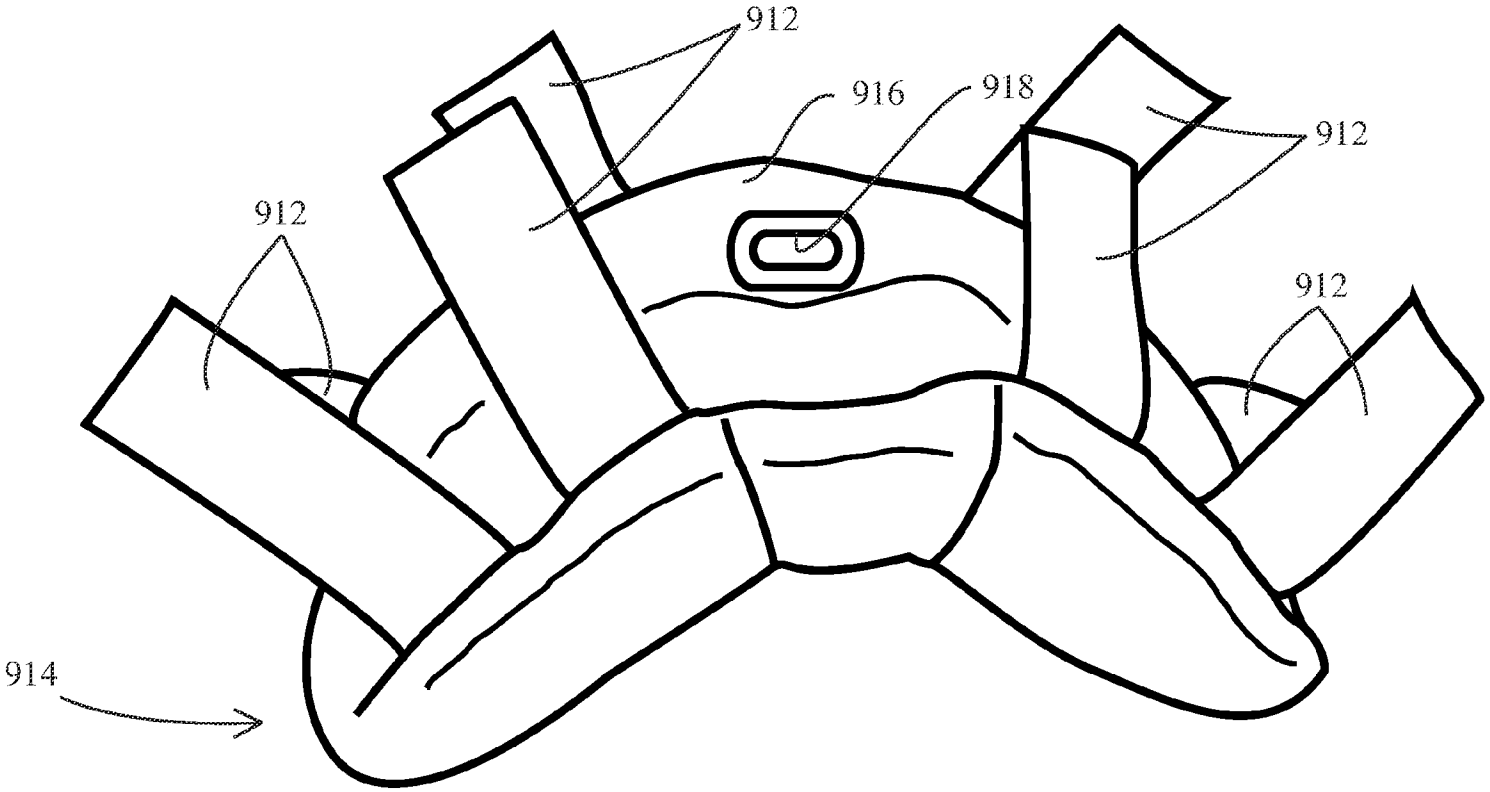

Referring to FIGS. 12-14, a shock absorber 500 in accordance with the third embodiment of the present invention can be seen. The shock absorber 500 has a support structure 502, two guide rods 522 and 532, two coil springs 554 and 556, first and second tubular sleeves 619 and 622, and a sliding member 542. These parts are essentially identical in structure and function to the corresponding parts of the shock absorber 100, and in turn the shock absorber 500 is essentially identical in structure and function to the shock absorber 100, except as to the differences noted below.

The lateral flanges 118, 120 and the holes 174, 176 have been eliminated from the support structure 502. Instead, the support structure 502 is provided with a plurality of tabs 518 that allow the support structure 502 to be welded to the bars of the head-engaging member 204 to thereby fix the support structure 502 to the head-engaging member 204.

Referring to FIGS. 15-25, a protective headgear 800 in accordance with the fourth embodiment of the present invention can be seen. In the headgear 800, the head-engaging portion 804 includes a shield 808 and a fixed frame 806. The shield 808 covers the forehead, the forward top portion of the skull, the sides of the head, and the chin of the wearer. The shield 808 has a face opening 811 for the area corresponding to the mouth, nose, and eyes of the wearer. The fixed frame 806 is fixedly attached to the shield 808 on the interior of the shield 808 such that the fixed frame 806 is positioned intermediate the shield 808 and the wearer's head. The fixed frame 806 essentially surrounds the area corresponding to the face opening 811 of the shield 808. Three shock absorber units 700 made in accordance with the present invention support the faceguard 802 relative to the head-engaging portion 804. These three shock absorber units 700 attach the face guard 802 to the fixed frame 806 and thus to the head-engaging portion 804. The shield 808 has openings 813 that allow the shock absorber units 700 to be attached to the fixed frame 806. The shield 808 has vent openings 815 in the top and lateral areas around the forehead region. The shield 808 may be made of fiberglass, carbon-fiber composite, KEVLAR®, molded polycarbonate, combinations thereof, and any other material suitable for use in the protective shell of protective headgear.

The shock absorber 700 has a support structure 702, two guide rods 722 and 732, two coil springs 754 and 756, first and second tubular sleeves 819 and 822, and a sliding member 742. These parts are essentially identical in structure and function to the corresponding parts of the shock absorber 100, and in turn the shock absorber 700 is essentially identical in structure and function to the shock absorber 100, except as to the differences noted below.

The lateral flanges 118, 120 and the holes 174, 176 have been eliminated from the support structure 702. Instead, the support structure 702 is provided with a slot 703 in the base plate 704 of the support structure 702. An insert 705 is provided that has a portion 707 that fits into the slot 703 and that has a flange 709 that is too large to pass through the slot 703. The insert 705 also has holes 711 for engagement by the support structure fasteners 762, 764. The support structure 702 is fixed to the head-engaging member 804 by placing the support structure fasteners 762, 764, which may be screws or rivets for example, through holes in the fixed frame 806 and then securing the support structure fasteners 762, 764 to the insert 705 to thereby capture the support structure 702 between the insert 705 and the fixed frame 806. Thus the shock absorber 700 is fixed to the head-engaging member 804. The guide rods should be supported high enough above the insert 705 so that the insert 705 and the support structure fasteners 762, 764 will not interfere with the travel of the sleeves 819, 822 and the sliding member 742 or with the proper functioning of the springs 754, 756. The holes 711 in the insert 705 may also be countersunk to further aid in preventing the support structure fasteners 762, 764 from interfering with the travel of the sliding member 742.

Alternatively, the support structure 702 may be provided with a plurality of holes in the base plate 704 of the support structure 702 that allow the support structure 702 to be fixed to the head-engaging member 804 using the support structure fasteners 762, 764, which may be screws or rivets for example. The holes in the base plate 704 of the support structure 702 for the support structure fasteners 762, 764 would preferably be countersunk or provided in a dimpled region of the base plate 704 of the support structure 702 so that the support structure fasteners 762, 764 do not interfere with the travel of the sleeves 819, 822 and the sliding member 742 or with the proper functioning of the springs 754, 756.

The fixed frame 806 is provided with spaced-apart bar portions 810 at locations corresponding to the shock absorbers 700. The support structure fasteners 762, 764 engage with a respective spaced-apart bar portion 810 to fix the support structure 702 to the fixed frame 806.

In the illustrated embodiment, a plurality of tabs 818 is provided on the frame 812 of the faceguard 802. Each of the tabs 818 has a hole that is engaged by a respective fastener 750 to secure the sliding member 742 of a respective shock absorber 700 to the faceguard 802. The head-engaging member 804 is preferably provided with padding, for example of a type similar to that illustrated in FIGS. 26-31, for engagement with the wearer's head. In the illustrated embodiment, the faceguard 802 is of the cage type and is similar to the faceguard 202. The protective headgear 800 is particularly well suited for use by a hockey goaltender.

Referring to FIGS. 26-31, examples of pads for use with the protective headgear of the present invention or other protective headgear can be seen. The pads include an upper pad 900 for engagement with the wearer's forehead and a lower pad 902 for engagement with the wearer's mandible at about the region of the chin or just above the chin. The pads 900 and 902 may be provided with cutouts 904 and 906, visible from the front of the pad, or they may be otherwise dimensioned and configured to clear the shock absorbers. The lower pad 908 uses a downward extending bill 910 to shield the wearer's chin from the lowermost shock absorber. A similar configuration is used for the upper pad 914, which has an upward extending bill 916 to shield the wearer's forehead from the uppermost shock absorber. The upper pad 914 is preferably also provided with an opening 918 for the straps (not shown) that are used to secure the headgear 200 to the wearer's head. The pads 900, 902, 908, and 914 are preferably provided with straps 912 that are equipped with hook-and-loop fastening systems for attaching the pads to the frames 206, 208, the shield 808 and the fixed frame 806. The pads preferably have a natural or simulated leather outer covering and a foam type cushioning material as the filling. The foam type cushioning material is preferably of a relatively firm variety.

Spring rates in the range of about 15 to about 50 lbs. seem to provide the best results. Most preferably, the spring rate is about 25 lbs. Any of the various disclosed shock absorbers and the various disclosed pads may be used with any of the disclosed protective headgear of the present invention or with other protective headgear.

Test Results

Testing methodology for assessing the risk of head injury associated with athletic headgear is promulgated by the National Operating Committee on Standards for Athletic Equipment (NOCSAE). There are only four independent facilities in the United States approved by the NOCSAE for performing testing of athletic equipment. A baseball catcher's mask in accordance with the present invention was tested at a NOCSAE-approved facility. In addition, currently-available competitive catcher's masks were also tested for comparison. The results of the testing are presented in Tables 1 and 2 below.

TABLE 1

Baseball Impacts
Required Velocity: 100 mph (43.81-45.60 m/s)

| Sample | Impact Location | Velocity (m/s) | Severity Index | Peak Acceleration (g) |
|---|---|---|---|---|
| Rawlings | Front | 43.86 | 149 | 123 |
| | Front | 44.37 | 169 | 135 |
| Wilson | Front | 44.24 | 90 | 54 |
| | Front | 43.86 | 112 | 127 |
| Champion | Front | 44.07 | 85 | 98 |
| | Front | 43.86 | 119 | 121 |
| Mask according to the present invention | Front | 44.20 | 43 | 76 |
| | Front | 43.86 | 59 | 74 |

TABLE 2

Softball Impacts
Required Velocity: 70 mph (30.35-32.23 m/s)

| Sample | Impact Location | Velocity (m/s) | Severity Index | Peak Acceleration (g) |
|---|---|---|---|---|
| Rawlings | Front | 30.71 | 96 | 111 |
| Wilson | Front | 30.77 | 44 | 72 |
| Champion | Front | 30.71 | 79 | 93 |
| Mask according to the present invention | Front | 30.82 | 11 | 49 |

The Severity Index (SI) is defined as follows:

$$SI = \int_0^T A^{2.5}\,dt$$

Where: A is the instantaneous resultant acceleration expressed as a multiple of g (acceleration of gravity); dt are the time increments in seconds; and the integration is carried out over the essential duration (T) of the acceleration pulse. The lower the SI, the lower the risk of injury will be, while the higher acceleration is correlated with a higher risk of injury. For a comparable SI, the higher acceleration would present a higher risk of injury.

As can be seen from these results, the mask according to the present invention provides significant reductions in both SI and peak acceleration and would therefore be expected to correspondingly reduce the risk of injury from ball impacts.

It is to be understood that the present invention is not limited to the embodiments described above, but encompasses any and all embodiments within the scope of the following claims.

The invention claimed is:

1. A shock absorber for supporting a protective faceguard relative to a head-engaging member, the shock absorber comprising:

a support structure adapted for attachment to one of the head-engaging member and the faceguard;

a guide rod supported by said support structure in a fixed position relative to said support structure, said guide rod having first and second end portions, a length, and a longitudinal axis;

a sliding member guided by said guide rod for rectilinear movement in a direction parallel to said longitudinal axis of said guide rod, said sliding member being adapted for attachment to another one of the head engaging member and the faceguard; and a resilient member acting on said sliding member to bias said sliding member toward said first end portion of said guide rod, wherein said resilient member can absorb at least a portion of the impact energy of an object impacting the faceguard when the impact causes said sliding member to move toward said second end portion of said guide rod, wherein said sliding member has an opening therethrough and said guide rod extends through said opening, and wherein said support structure supports said guide rod at said first end portion of said guide rod and at said second end portion of said guide rod.

2. The shock absorber according to claim 1, wherein said resilient member is a coil spring having a plurality of coils and said guide rod extends through said plurality of coils.

3. The shock absorber according to claim 2, wherein said coil spring is positioned intermediate a portion of said sliding member and said second end portion of said guide rod.

4. The shock absorber according to claim 3, wherein said coil spring has a first end and a second end and wherein said first end of said coil spring bears directly or indirectly against a portion of said sliding member and said second end of said coil spring bears directly or indirectly against a portion of said support structure proximate said second end portion of said guide rod.

5. The shock absorber according to claim 3, wherein said sliding member has at least one hole for engagement by at least one sliding member fastener to thereby attach said sliding member to the another one of the head engaging member and the faceguard.

6. The shock absorber according to claim 5, wherein said support structure has means for engagement by at least one support structure fastener to thereby attach said support structure to the one of the head engaging member and the faceguard.

7. The shock absorber according to claim 1, wherein said support structure is a bracket comprising a base plate, a first endplate having a hole for said first end portion of said guide rod, a second endplate having a hole for said second end portion of said guide rod, a first lateral flange provided on a first side of said base plate, and a second lateral flange provided on a second side of said base plate, said first endplate being provided proximate a first end of said base plate, said second endplate being provided proximate a second end of said base plate opposite said first endplate.

8. The shock absorber according to claim 7, wherein said first lateral flange extends approximately laterally from said first side of said base plate, said second lateral flange extends approximately laterally from said second side of said base plate in a direction approximately opposite that of said first lateral flange.

9. The shock absorber according to claim 7, wherein each of said first lateral flange and said second lateral flange has means for engagement by at least one support structure fastener to thereby attach said support structure to the one of the head engaging member and the faceguard.

10. The shock absorber according to claim 1, wherein movement of said sliding member is limited to a portion of said length of said guide rod.

11. The shock absorber according to claim 1, wherein said guide rod is a first guide rod having said first and second end portions, said length, and said longitudinal axis, and the shock absorber further comprises a second guide rod extending parallel to said first guide rod, wherein said second guide rod has first and second end portions, a length, and a longitudinal axis extending parallel to said longitudinal axis of said first guide rod.

12. The shock absorber according to claim 11, wherein said sliding member has a first opening therethrough and said first guide rod extends through said first opening and said sliding member has a second opening therethrough and said second guide rod extends through said second opening.

13. The shock absorber according to claim 12, wherein said support structure supports said first guide rod at said first end portion of said first guide rod and at said second end portion of said first guide rod and said support structure supports said second guide rod at said first end portion of said second guide rod and at said second end portion of said second guide rod.

14. The shock absorber according to claim 13, wherein said resilient member is a first coil spring having a plurality of coils and said first guide rod extends through said plurality of coils of said first spring, and the shock absorber comprises a second coil spring having a plurality of coils and said second guide rod extends through said plurality of coils of said second spring.

15. The shock absorber according to claim 14, wherein said first coil spring is positioned intermediate a first portion of said sliding member and said second end of said first guide rod, and said second coil spring is positioned intermediate a second portion of said sliding member and said second end of said second guide rod.

16. The shock absorber according to claim 15, wherein said sliding member has at least one hole for engagement by at least one sliding member fastener to thereby attach said sliding member to the another one of the head engaging member and the faceguard.

17. The shock absorber according to claim 16, wherein said support structure has means for engagement by at least one support structure fastener to thereby attach said support structure to the one of the head engaging member and the faceguard.

18. The shock absorber according to claim 15, wherein said first coil spring has a first end and a second end and wherein said first end of said first coil spring bears directly or indirectly against a first portion of said sliding member and said second end of said first coil spring bears directly or indirectly against a first portion of said support structure proximate said second end of said first guide rod, and said second coil spring has a first end and a second end and wherein said first end of said second coil spring bears directly or indirectly against a second portion of said sliding member and said second end of said second coil spring bears directly or indirectly against a second portion of said support structure proximate said second end of said second guide rod.

19. The shock absorber according to claim 12, further comprising:

a first tubular sleeve provided in engagement with said first opening of said sliding member, said first guide rod extending through said first tubular sleeve, so as to reduce the possibility of said sliding member jamming on said first guide rod; and a second tubular sleeve provided in engagement with said second opening of said sliding member, said second guide rod extending through said second tubular sleeve, so as to reduce the possibility of said sliding member jamming on said second guide rod.

20. The shock absorber according to claim 11, wherein said support structure is a bracket comprising a base plate, a first endplate having a first hole for said first end portion of said first guide rod and a second hole for said first end portion of said second guide rod, a second endplate having a first hole for said second end portion of said first guide rod and a second hole for said second end portion of said second guide rod, a first lateral flange provided on a first side of said base plate, and a second lateral flange provided on a second side of said base plate, said first endplate being provided proximate a first end of said base plate, said second endplate being provided proximate a second end of said base plate opposite said first endplate.

21. The shock absorber according to claim 20, wherein said first lateral flange extends approximately laterally from said first side of said base plate, said second lateral flange extends approximately laterally from said second side of said base plate in a direction approximately opposite that of said first lateral flange.

22. The shock absorber according to claim 20, wherein each of said first lateral flange and said second lateral flange has means for engagement by at least one support structure fastener to thereby attach said support structure to the one of the head engaging member and the faceguard.

23. The shock absorber according to claim 11, wherein movement of said sliding member in a direction parallel to said longitudinal axis of said first guide rod is limited to a portion of said length of said first guide rod.

24. A protective headgear comprising:

a head-engaging portion;

a faceguard; and a plurality of shock absorbers according to claim 1, each of said plurality of shock absorbers connecting said faceguard to said head-engaging portion.

25. The headgear in accordance with claim 24, wherein said head-engaging portion comprises first and second frame members, said first frame member being larger than said second frame member and being sized to substantially surround a wearer's face, a plurality of pairs of L-shaped bars connecting said second frame member to said first frame member, each pair of L-shaped bars supporting a respective one of said plurality of shock absorbers such that said respective shock absorber is in a protected location between said first frame member and said second frame member of said head-engaging portion.

26. The headgear in accordance with claim 24, wherein said head-engaging portion further comprises padding.

27. The headgear in accordance with claim 26, wherein said padding comprises an upper pad for engagement with the wearer's forehead and a lower pad for engagement with the wearer's mandible.

28. The shock absorber according to claim 1, further comprising:

a tubular sleeve provided in engagement with said opening of said sliding member, said guide rod extending through said tubular sleeve, so as to reduce the possibility of said sliding member jamming on said guide rod.

29. A shock absorber for supporting a protective faceguard relative to a head-engaging member, the shock absorber comprising:

a support structure adapted for attachment to one of the head-engaging member and the faceguard;

a guide rod supported by said support structure in a fixed position relative to said support structure, said guide rod having first and second end portions, a length, and a longitudinal axis;

a sliding member guided by said guide rod for rectilinear movement in a direction parallel to said longitudinal axis of said guide rod, said sliding member being adapted for attachment to another one of the head engaging member and the faceguard; and a resilient member acting on said sliding member to bias said sliding member toward said first end portion of said guide rod, wherein said resilient member can absorb at least a portion of the impact energy of an object impacting the faceguard when the impact causes said sliding member to move toward said second end portion of said guide rod, wherein said sliding member has an opening therethrough and said guide rod extends through said opening, wherein said support structure supports said guide rod at said first end portion of said guide rod and at said second end portion of said guide rod, and wherein said support structure has a hole for said first end portion of said guide rod and a hole for said second end portion of said guide rod.

30. The shock absorber according to claim 29, wherein said resilient member is a coil spring having a plurality of coils and said guide rod extends through said plurality of coils.

31. The shock absorber according to claim 30, wherein said coil spring is positioned intermediate a portion of said sliding member and said second end portion of said guide rod.

32. The shock absorber according to claim 31, wherein said coil spring has a first end and a second end and wherein said first end of said coil spring bears directly or indirectly against a portion of said sliding member and said second end of said coil spring bears directly or indirectly against a portion of said support structure proximate said second end portion of said guide rod.

33. The shock absorber according to claim 31, wherein said sliding member has at least one hole for engagement by at least one sliding member fastener to thereby attach said sliding member to the another one of the head engaging member and the faceguard.

34. The shock absorber according to claim 33, wherein said support structure has means for engagement by at least one support structure fastener to thereby attach said support structure to the one of the head engaging member and the faceguard.

35. The shock absorber according to claim 29, wherein said support structure is a bracket comprising a base plate, a first endplate having said hole for said first end portion of said guide rod, a second endplate having said hole for said second end portion of said guide rod, a first lateral flange provided on a first side of said base plate, and a second lateral flange provided on a second side of said base plate, said first endplate being provided proximate a first end of said base plate, said second endplate being provided proximate a second end of said base plate opposite said first endplate.

36. The shock absorber according to claim 35, wherein said first lateral flange extends approximately laterally from said first side of said base plate, said second lateral flange extends approximately laterally from said second side of said base plate in a direction approximately opposite that of said first lateral flange.

37. The shock absorber according to claim 35, wherein each of said first lateral flange and said second lateral flange has means for engagement by at least one support structure fastener to thereby attach said support structure to the one of the head engaging member and the faceguard.

38. A protective headgear comprising:

a head-engaging portion;

a faceguard; and a plurality of shock absorbers according to claim 29, each of said plurality of shock absorbers connecting said faceguard to said head-engaging portion.

* * * * *